US011276524B2

(12) United States Patent
Tsunenaga et al.

(10) Patent No.: US 11,276,524 B2
(45) Date of Patent: Mar. 15, 2022

(54) IGNITION COIL

(71) Applicant: DENSO CORPORATION, Kariya (JP)

(72) Inventors: Koji Tsunenaga, Kariya (JP); Shigemi Ito, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/826,448

(22) Filed: Mar. 23, 2020

(65) Prior Publication Data

US 2020/0312544 A1 Oct. 1, 2020

(30) Foreign Application Priority Data

Mar. 26, 2019 (JP) ..... JP2019-059260

(51) Int. Cl.

| | |
|---|---|
| ***H01T 13/04*** | (2006.01) |
| ***H01F 38/12*** | (2006.01) |
| ***H01R 13/24*** | (2006.01) |
| ***H01T 13/44*** | (2006.01) |
| ***H01T 13/41*** | (2006.01) |

(52) U.S. Cl.

CPC ..... *H01F 38/12* (2013.01); *H01R 13/2421* (2013.01); *H01T 13/04* (2013.01); *H01T 13/41* (2013.01); *H01T 13/44* (2013.01)

(58) Field of Classification Search

CPC ..... H01R 13/2421; H01R 13/2478; H01R 13/2485

USPC ..... 336/90

See application file for complete search history.

(56) References Cited

U.S. PATENT DOCUMENTS

| | | | | |
|---|---|---|---|---|
| 4,621,881 | A * | 11/1986 | Johansson | H01T 13/04 174/138 S |
| 5,487,676 | A * | 1/1996 | Maruyama | F02P 3/02 324/399 |
| 5,749,742 | A * | 5/1998 | Bertuzzi, Jr. | H01R 13/6276 439/125 |
| 8,474,428 | B2 | 7/2013 | Lykowski et al. | |
| 2012/0169207 | A1* | 7/2012 | Kato | H01T 13/38 313/141 |
| 2012/0186568 | A1 | 7/2012 | Steinberger | |

FOREIGN PATENT DOCUMENTS

| | | |
|---|---|---|
| DE | 85 18 139 U1 | 11/1986 |
| DE | 38 52 300 T2 | 4/1995 |

* cited by examiner

*Primary Examiner* — Christopher M Raabe

(74) *Attorney, Agent, or Firm* — Nixon & Vanderhye P.C.

(57) ABSTRACT

An ignition coil includes a coil main body portion, a conductive member, and a protective portion. The coil main body portion generates a high voltage. The conductive member electrically connects the coil main body portion and a terminal metal fitting of a spark plug. The conductive member is arranged inside the protective portion. The protective portion has an electrically insulating property. The conductive member includes an elastic portion that elastically deforms in a longitudinal direction of the conductive member, and a conductive terminal that is arranged on a distal end side of the elastic portion. The conductive terminal has a distal end surface that includes a concave surface or a convex surface that abuts on the terminal metal fitting of the spark plug. A contact portion between the concave surface or the convex surface and the terminal metal fitting of the spark plug has an annular shape.

10 Claims, 32 Drawing Sheets

IGNITION COIL

CROSS-REFERENCE TO RELATED APPLICATIONS

This application is based on and claims the benefit of priority from Japanese Patent Application No. 2019-059260, filed Mar. 26, 2019. The entire disclosure of the above application is incorporated herein by reference.

BACKGROUND

Technical Field

The present disclosure relates to an ignition coil.

Related Art

An ignition coil is used in an internal combustion engine for automobiles and the like. The ignition coil applies a high voltage to a spark plug and causes the spark plug to generate discharge. A known ignition coil includes a coil main body portion, a conductive member, and a protective cover. The coil main body portion generates the high voltage. The conductive member supplies the generated high voltage from the coil main body portion to the spark plug. The protective cover has an insulating property and covers the conductive member from an outer circumferential side.

SUMMARY

The present disclosure provides an ignition coil that includes a coil main body portion, a conductive member, and a protective portion. The coil main body portion generates a high voltage. The conductive member electrically connects the coil main body portion and a terminal metal fitting of a spark plug. The conductive member is arranged inside of the protective portion. The protective portion has an electrically insulating property. The conductive member includes an elastic portion and a conductive terminal. The elastic portion elastically deforms in a longitudinal direction of the conductive member. The conductive terminal is arranged on a distal end side of the elastic portion. The conductive terminal has a distal end surface that includes a concave surface or a convex surface that abuts on the terminal metal fitting of the spark plug. A contact portion between the concave surface or the convex surface and the terminal metal fitting of the spark plug has an annular shape.

DESCRIPTION OF THE EMBODIMENTS

Figure 1:
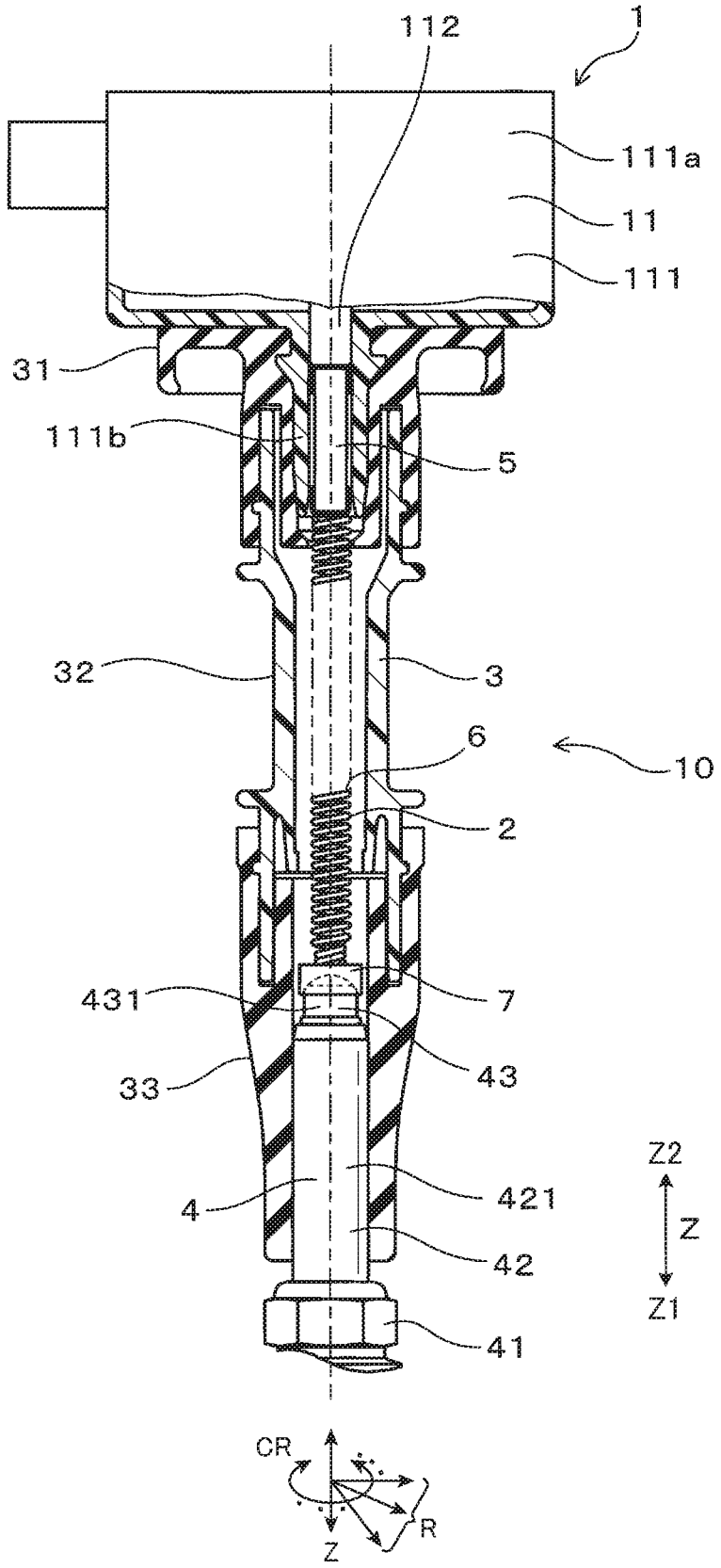
FIG. 1 is a partial cross-sectional front view of an ignition coil and a spark plug for an internal combustion engine according to a first embodiment.

An ignition coil that applies a high voltage to a spark plug and causes the spark plug to generate discharge is used in an internal combustion engine for automobiles and the like. As such an ignition coil, JP-A-2013-501180 discloses an ignition coil that includes a coil main body portion, a conductive member, and a protective cover. The coil main body portion generates the high voltage. The conductive member conducts the generated high voltage from the coil main body portion to the spark plug. The protective cover has an insulating property and covers the conductive member from an outer circumferential side. In JP-A-2013-501180, the conductive member includes a coil spring.

Here, the ignition coil and the spark plug that are described in JP-A-2013-501180 have a structure in which a recessed portion, described hereafter, is formed in a terminal metal fitting of the spark plug, and a distal end portion of the coil spring is inserted into the recessed portion.

The recessed portion is shaped such that a proximal end surface of the terminal metal fitting of the spark plug is recessed toward a distal end side. In addition, a side surface of the recessed portion is formed into a tapered shape that increases in diameter toward a proximal end side. Furthermore, the distal end portion of the coil spring that is inserted into the recessed portion is formed into a circular conical shape that decreases in diameter toward the distal end side, so as to follow the shape of the side surface of the recessed portion. As a result of this configuration, the ignition coil and the spark plug described in JP-A-2013-501180 ensures contact area between the side surface of the recessed portion of the terminal metal fitting of the spark plug and the distal end portion of the coil spring, and ensures electrical connectivity therebetween.

However, high precision is required in the manufacturing of the coil spring to form the distal end portion of the coil spring so as to follow the side surface of the recessed portion. Therefore, improvement in the contact area between the side surface of the recessed portion and the distal end portion of the coil spring is difficult to achieve. Thus, in the ignition coil described in JP-A-2013-501180, there may be only a few or even only one contact points between the distal end portion of the coil spring and the terminal metal fitting of the spark plug. Therefore, in the ignition coil described in JP-A-2013-501180, there is room for improvement in terms of ensuring connection reliability between the coil spring and the terminal metal fitting.

It is thus desired to provide an ignition coil that is capable of improving connection reliability between a conductive member and a terminal metal fitting of a spark plug.

An exemplary embodiment of the present disclosure provides an ignition coil that includes a coil main body portion, a conductive member, and a protective portion. The coil main body portion generates a high voltage. The conductive member electrically connects the coil main body portion and a terminal metal fitting of a spark plug. The protective portion has an electrically insulating property. The conductive member is arranged inside of the protective portion. The conductive member includes an elastic portion and a conductive terminal. The elastic portion elastically deforms in a longitudinal direction of the conductive member. The conductive terminal is arranged on a distal end side of the elastic portion. The conductive terminal has a distal end surface that includes a concave surface or a convex surface and abuts on the terminal metal fitting of the spark plug. The concave surface is formed to be recessed toward a proximal end side toward an inner circumference side. The convex surface is formed to protrude toward a distal end side toward the inner circumference side. A contact portion between the concave surface or the convex surface and the terminal metal fitting of the spark plug has an annular shape.

In the ignition coil according to the above-described exemplary embodiment, the conductive terminal is attached to the distal end of the elastic portion. In addition, the distal end surface of the conductive terminal has a concave surface or a convex surface. The concave surface is recessed toward the proximal end side toward the inner circumferential side and abuts on the terminal metal fitting of the spark plug. The convex surface protrudes toward the distal end side toward the inner circumferential side and abuts on the terminal metal fitting of the spark plug. Furthermore, the distal end surface of the conductive terminal is configured such that the contact portion with the terminal metal fitting of the spark plug can have an annular shape. Consequently, a contact area between the concave surface or the convex surface and the terminal metal fitting of the spark plug can be increased. Reliability of electrical connection between the conductive member and the terminal metal fitting of the spark plug can be easily ensured.

As described above, according to the above-described exemplary embodiment, an ignition coil that is capable of improving connection reliability between a conductive member and a terminal metal fitting of a spark plug can be provided.

First Embodiment

An ignition coil according to an embodiment will be described with reference to FIG. 1 to FIG. 12.

As shown in FIG. 1, an ignition coil 1 according to the present embodiment includes a coil main body portion 11, a conductive member 2, and a protective portion 3.

The coil main body portion 11 generates a high voltage. The conductive member 2 electrically connects the coil main body portion 11 and a terminal metal fitting 43 of a spark plug 4. The conductive member 2 is provided inside the protective portion 3. The protective portion 3 has an electrically insulating property.

Figure 2:
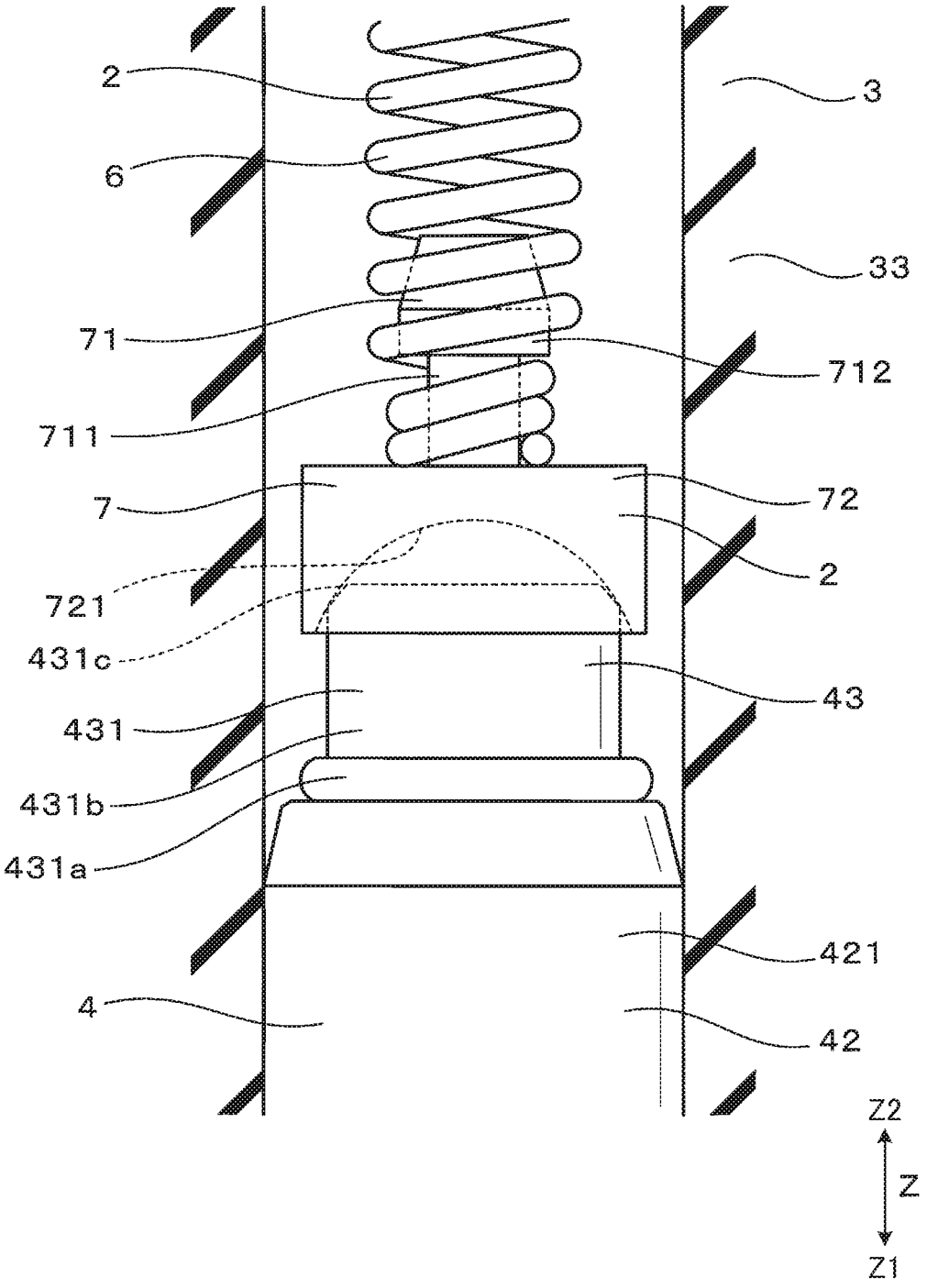
FIG. 2 is an enlarged view of a periphery of a conductive terminal in FIG. 1.
Figure 3:
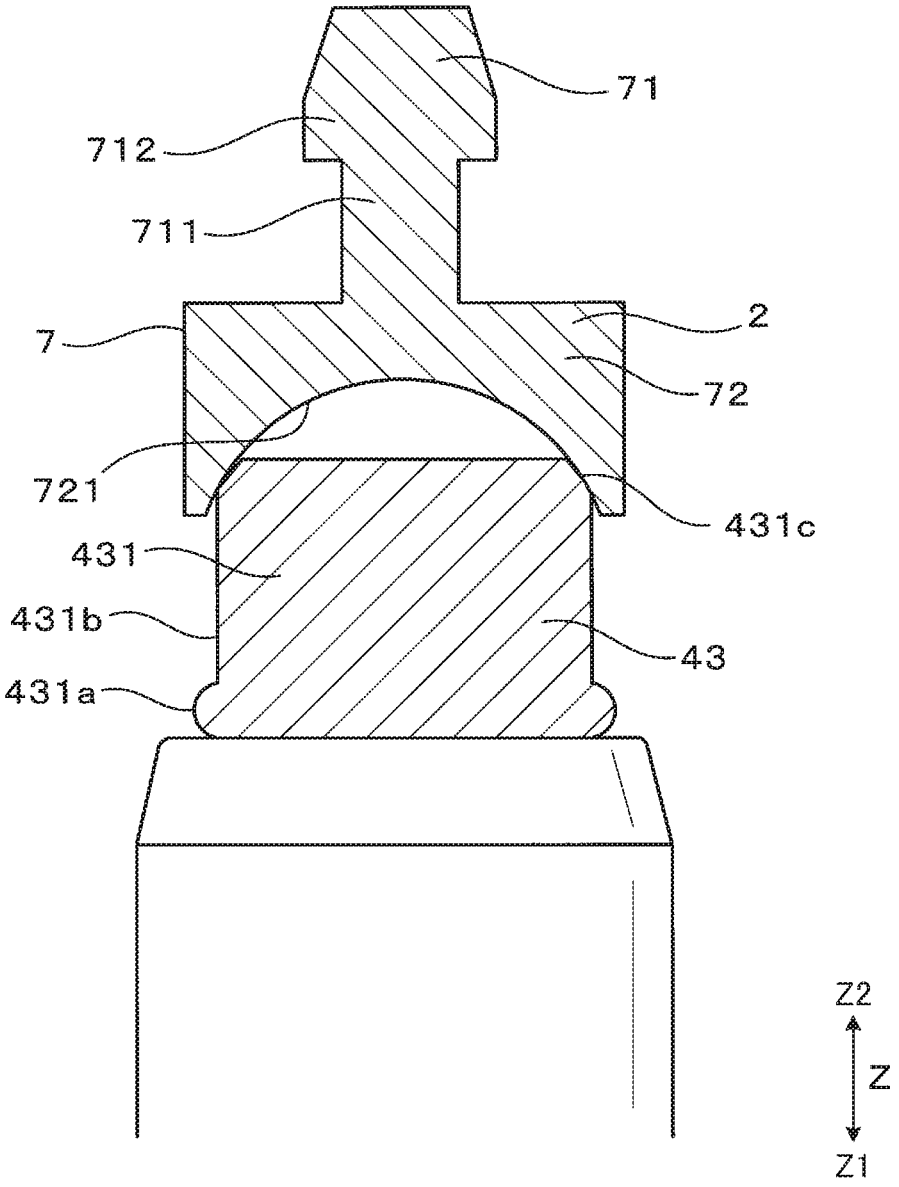
FIG. 3 is a partial cross-sectional front view of the conductive terminal and the spark plug according to the first embodiment.

The conductive member 2 includes an elastic portion 6 and a conductive terminal 7. The elastic portion 6 is capable of elastically deforming in a longitudinal direction of the conductive member 2. The conductive terminal 7 is provided on a distal end side of the elastic portion 6. As shown in FIG. 2 and FIG. 3, a concave surface (recessed surface) 721 is provided on a distal end surface of the conductive terminal 7. The concave portion 721 is shaped so as to recess toward a proximal end side toward an inner circumferential side. The concave surface 721 abuts on the terminal metal fitting 43 of the spark plug 4. The concave surface 721 is configured such that a portion thereof that abuts on the terminal metal fitting 43 can be formed into an annular shape. Here, a contact portion between two members being formed into an annular shape means that the contact portion between the two members is formed in three locations or more in a circumferential direction of the ignition coil 1.

The present embodiment will be described in detail hereafter.

In the present specification, a direction in which center axes of the conductive member 2 and the protective portion 3 extend is an axial direction Z. In addition, one side in the axial direction Z that is a side of the ignition coil 1 on which the spark plug 4 is connected is referred to as a distal end side (tip end side) Z1. A side opposite the distal end side Z1 is a proximal end side (base end side) Z2. In addition, when a direction is simply described as a radial direction R, the direction refers to a radial direction R of the protective portion 3. When a direction is simply described as a circumferential direction CR, the direction refers to a circumferential direction CR of the protective portion 3.

The ignition coil 1 according to the present embodiment is connected to the spark plug 4. The spark plug 4 is attached to a plug hole in a cylinder head of an automobile, a cogeneration system, or the like. In addition, the ignition coil 1 is used as a means for applying a high voltage to the spark plug 4. The ignition coil 1 is attached to the cylinder head by the protective portion 3 being inserted into the plug hole.

Although not shown in the drawings, the coil main body portion 11 includes a primary coil and a secondary coil. The primary coil and the secondary coil are magnetically coupled to each other. The coil main body portion 11 is configured to generate a high voltage for ignition by the spark plug 4 in the secondary coil, as a result of changes over time in a current that flows through the primary coil. As shown in FIG. 1, the coil main body portion 11 includes a case 111 that houses the primary coil and the secondary coil.

The case 111 is composed of a material that has an electrically insulating property. As shown in FIG. 1, the case 111 includes a case main body portion 111*a* and a tower portion 111*b*. The case main body portion 111*a* has a rectangular box shape of which the proximal end side Z2 is open. The primary coil and the secondary coil are housed inside the case main body portion 111*a*. The tower portion 111*b* is formed so as to protrude toward the distal end side Z1 from a center portion of a bottom wall of the case main body portion 111*a*. The tower portion 111*b* has a cylindrical shape that is formed in the axial direction Z. Space inside the tower portion 111*b* communicates with space inside the case main body portion 111*a*. In the ignition coil 1, a high voltage terminal 112 is fitted into the proximal end portion of the tower portion 111*b*. The high voltage terminal 112 is electrically connected to the secondary coil. The high voltage terminal 112 serves as an output terminal of the ignition coil 1. In addition, the cylindrical protective portion 3 is assembled to the tower portion 111*b*.

The protective portion 3 includes a rubber seal 31, a pole joint 32, and a plug cap 33. The rubber seal 31 is assembled to the tower portion 111*b* so as to cover the tower portion 111*b* from an outer circumferential side. The rubber seal 31 is composed of a material such as rubber that is capable of elastic deformation. A proximal end portion of the rubber seal 31 is in close contact with both the case 111 of the ignition coil 1 and the cylinder head to which the ignition coil 1 is attached. The rubber seal 31 ensures sealing between the case 111 of the ignition coil and the cylinder head. The pole joint 32 is fitted onto a distal end portion of the rubber seal 31.

The pole joint 32 is composed of a material that is harder than that of the rubber seal 31 and has an electrically insulating property. For example, the pole joint 32 is composed of a resin that is formed into a cylindrical shape that is elongated in the axial direction Z. In addition, the plug cap 33 is fitted onto a distal end of the pole joint 32.

The plug cap 33 is composed of a material that is capable of elastic deformation and has an electrically insulating property. For example, the plug gap 33 is composed of rubber. The spark plug 4 is inserted into the plug cap 33 from the distal end side Z1 thereof. In addition, the conductive member 2 is arranged inside of the tower portion 111*b* and the protective portion 3.

The conductive member 2 includes a resistor 5, an elastic portion 6, and the conductive terminal 7. The resistor 5 suppresses a flow of high-frequency noise current into the ignition coil 1 that is caused by a spark discharge being generated in the spark plug 4. The resistor 5 is inserted into the distal end side Z1 of the high frequency terminal 112 in the tower portion 111*b*. The resistor 5 is electrically connected to the high frequency terminal 112.

The elastic portion 6 is composed of a coil spring. Hereafter, the elastic portion 6 is referred to as a coil spring 6. The coil spring 6 is has a coil shape that is wound in the axial direction Z. The coil spring 6 is capable of stretching and contracting in the axial direction Z. The coil spring 6 is assembled to the ignition coil 1 in a state in which the coil spring 6 is compressed in the axial direction Z. In addition, a proximal end portion of the coil spring 6 elastically presses the resistor 5 to the proximal end side Z2. As shown in FIG. 1 and FIG. 2, the conductor terminal 7 is mounted in a distal end portion of the coil spring 6.

The conductive terminal 7 is composed of a material that has conductivity. For example, the conductive terminal 7 is composed of a conductive material, such as steel, iron, a copper alloy, aluminum, carbon, a conductive resin, or a conductive rubber. For example, when the conductive terminal 7 is composed of steel, a copper alloy, or aluminum, the conductive terminal can be manufactured by forging and cutting. When the conductive terminal 7 is composed of carbon, the conductive terminal 7 can be manufactured by sintering. When the conductive terminal 7 is composed of a conductive resin, the conductive terminal 7 can be manufactured by molding. Here, the conductive terminal 7 is not necessarily required to ensure high conductivity. For example, as a result of the conductive terminal 7 being composed of a material that has moderately low conductivity, an effect of suppressing radio noise that is generated in accompaniment with the spark discharge that is generated in a discharge gap of the spark plug 4 can be obtained.

As shown in FIG. 2 to FIG. 6, the conductive terminal 7 has a rotating-body shape that has rotational symmetry relative to a rotation axis that extends in the axial direction Z. As shown in FIG. 2, the conductive terminal 7 includes a spring connecting portion 71 and a plug connecting portion 72. The spring connecting portion 71 is connected to the coil spring 6. The plug connecting portion 72 is connected to the terminal metal fitting 43 of the spark plug 4.

As shown in FIG. 2 to FIG. 5, the spring connecting portion 71 is formed into a columnar shape that protrudes toward the proximal end side Z2 in the conductor terminal 7. The spring connecting portion 71 includes a small diameter portion 711 and a large diameter portion 712. The small diameter portion 711 is formed in a distal end portion Z1 of the spring connecting portion 71. The large diameter portion 712 is formed further toward the proximal end side Z2 than the small diameter portion 711 and has a larger outer diameter than the small diameter portion 711. The small diameter portion 711 has a circular columnar shape that is formed in the axial direction Z. An outer shape of the small diameter portion 711 when viewed in the axial direction Z is smaller than a portion of the spring connecting portion 71 that is adjacent to the small diameter portion 711 on the proximal end side Z2 (that is, the large diameter portion 712). The large diameter portion 712 is formed so as to protrude further toward the outer circumferential side than the small diameter portion 711. In addition, a proximal end portion of the large diameter portion 712 has a truncated conical shape that decreases in diameter toward the proximal end side Z2. As a result, insertion of the spring connecting portion 71 inside the coil spring 6 is facilitated.

As shown in FIG. 2, the distal end portion of the coil spring 6 is wound around the small diameter portion 711 by a single turn or more. An inner diameter of the distal end portion of the coil spring 6 that is wound around the small diameter portion 711 is smaller than an outer diameter of the portion of the spring connecting portion 71 that is adjacent to the small diameter portion 711 on the proximal end side Z2 (that is, the large diameter portion 712). As a result, the conductive terminal 7 is held in the distal end portion of the coil spring 6. According to the present embodiment, the distal end portion of the coil spring 6 is wound around the small diameter portion 711 by two turns or more. In addition, the distal end of the coil spring 6 abuts on a proximal end surface of the plug connecting portion 72 of the conductive terminal 7.

As shown in FIG. 2 to FIG. 5, the plug connecting portion 72 is formed so as to have a larger diameter than the spring connecting portion 71. The spring connecting portion 71 is formed further toward the proximal end side Z2 from a center portion of a surface of the plug connecting portion 72 on the proximal end side Z2. The outer shape of the plug connecting portion 72 is formed into a circular columnar shape that is relatively low in height.

The plug connecting portion 72 includes a concave surface (recessed surface) 721 on a distal end surface thereof. The concave surface 721 has a shape in which a center portion of the distal end surface of the plug connecting portion 72, excluding a peripheral edge portion, is recessed toward the proximal end side Z2. The concave surface 721 is formed into a hemispherical surface. As a result, the overall concave surface 721 is curved toward the inner circumferential side toward the proximal end side Z2.

Next, an ignition apparatus 10 that includes the ignition coil 1 and the spark plug 4 that is assembled to the ignition coil 1 will be described.

As shown in FIG. 1, the spark plug 4 that is inserted into the ignition coil 1 includes a housing 41, an insulator 42, and the terminal metal fitting 43. The housing 41 is formed into a cylindrical shape. An attachment screw (not shown) is formed on an outer circumferential portion of the housing 41. The attachment screw is attached to a female screw hole that is formed in the plug hole of the cylinder head. The insulator 42 is formed into a cylindrical shape and is held inside the housing 41. The insulator 42 includes an insulator head portion 421 that protrudes from the housing 41 toward the proximal end side Z2.

Figure 4:
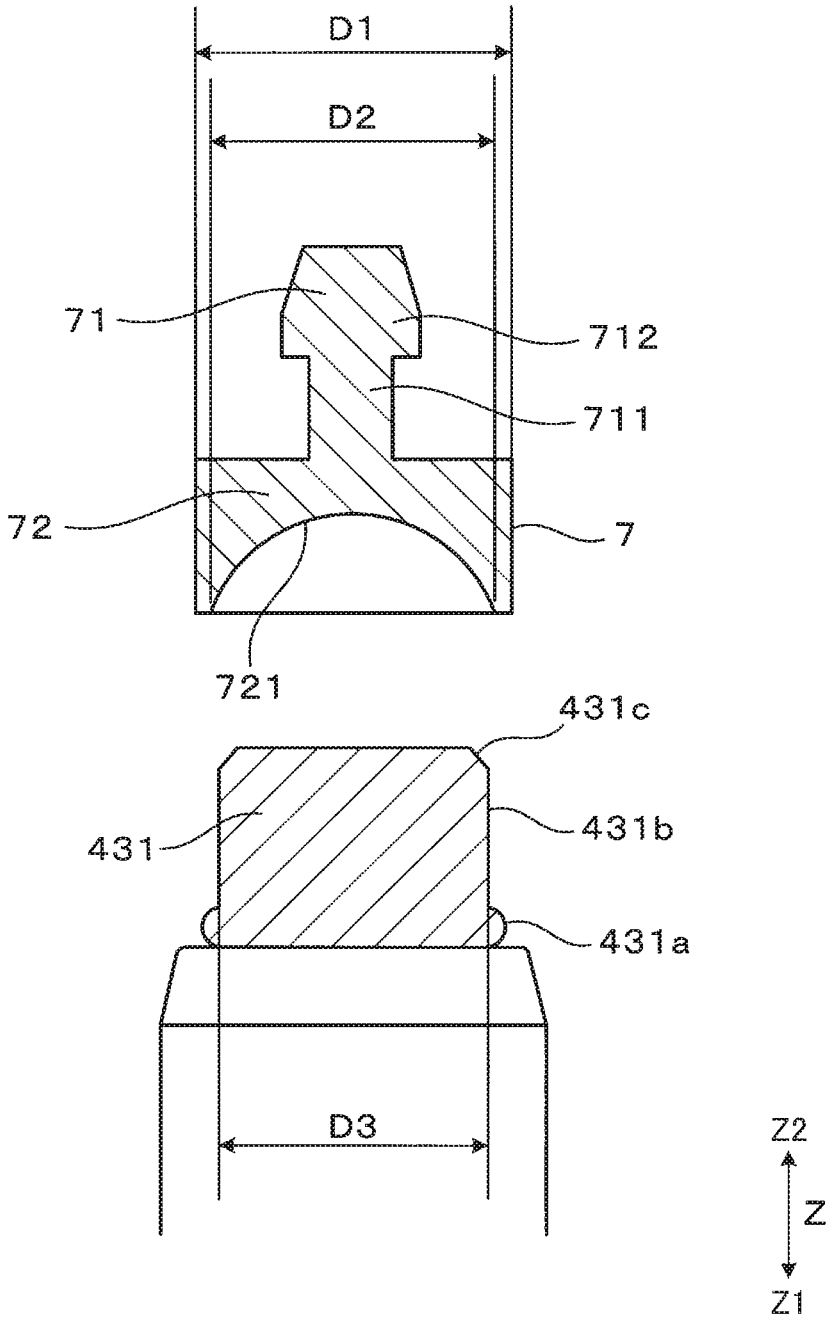
FIG. 4 is an exploded view in which the conductive terminal and the spark plug in FIG. 3 are separated.
Figure 5:
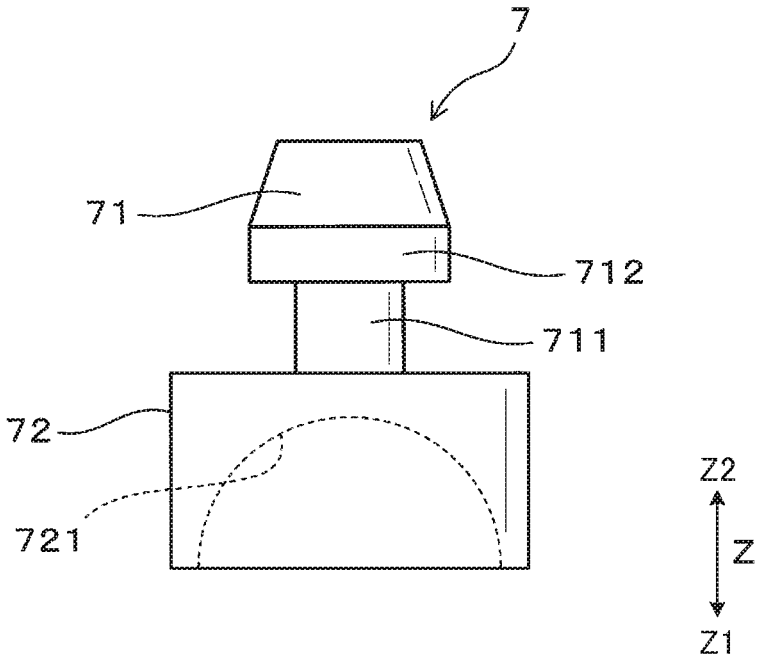
FIG. 5 is a front view of the conductive terminal according to the first embodiment.
Figure 6:
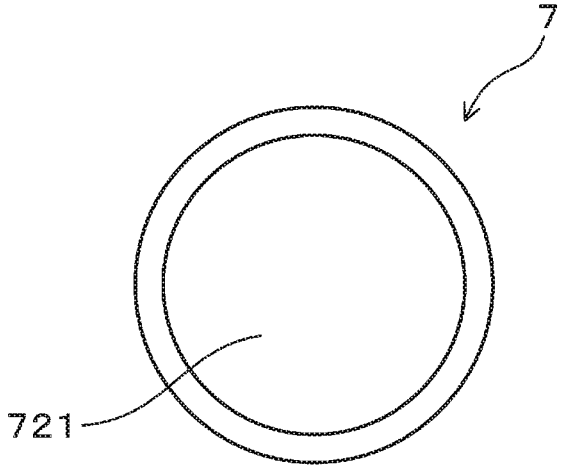
FIG. 6 is a bottom view of the conductive terminal viewed from a distal end side, according to the first embodiment.

For example, the terminal metal fitting 43 may be composed of iron. A portion of the terminal metal fitting 43 excluding a proximal end portion thereof is arranged inside the insulator 42. The proximal end portion of the terminal metal fitting 43 serves as a protruding terminal portion 431 that protrudes from the insulator head portion 421 toward the proximal end side Z2. As shown in FIG. 2 to FIG. 4, the protruding terminal portion 431 includes a terminal flange portion 431*a* in a distal end portion thereof. The terminal flange portion 431*a* protrudes further toward the outer circumferential side than other portions of the protruding terminal portion 431. The terminal flange portion 431*a* abuts on a proximal end surface of the insulator 42. The protruding terminal portion 431 also includes a terminal main body portion 431*b*. The terminal main body portion 431*b* has a circular columnar shape and is provided from the terminal flange portion 431*a* toward the proximal end side Z2. The protruding terminal portion 431 has a rotating-body shape that has rotational symmetry relative to a rotation axis that extends in the axial direction Z.

In the terminal main body 431*b*, a terminal corner portion 431*c* that is a corner portion between a proximal end surface and a side surface thereof has a tapered shape. The terminal corner portion 431*c* is formed into a tapered shape that tapers toward the inner circumferential side (radially inward) toward the proximal end side Z2. The terminal corner portion 431*c* serves as a guide to facilitate arrangement of the protruding terminal portion 431 of the terminal metal fitting 43 of the spark plug 4 inside the concave surface 721 of the conductive terminal 7, when the spark plug 4 is inserted into the plug cap 33.

The spark plug 4 is assembled to the ignition coil 1 by the insulator head portion 421 being inserted into the plug cap 33 of the ignition coil 1 from the distal end side Z1 of the plug cap 33.

Here, as shown in FIG. 4, a maximum outer diameter of the conductive terminal 7 is denoted by D1. An outer diameter of an open end (that is, the distal end portion) of the concave surface 721 is denoted by D2. An outer diameter of a portion of the terminal main body portion 431*b* that is inserted into the concave surface 721 is denoted by D3. At this time, diameters D1 to D3 satisfy a relationship of D1>D2>D3. As a result of the outer diameter D2 of the open end of the concave surface 721 being larger than the outer diameter D3 of the terminal main body portion 431*b*, when the spark plug 4 is assembled to the ignition coil 1, the terminal main body portion 431*b* of the spark plug 4 can be inserted into the inner side of the concave surface 721. In addition, the maximum outer diameter D1 of the conductive terminal 7 is smaller than a minimum inner diameter of the plug cap 33.

As shown in FIG. 2 and FIG. 3, in a state in which the spark plug 4 is assembled to the ignition coil 1, the terminal corner portion 431*c* of the terminal metal fitting 43 abuts on the concave surface 721 of the conductive terminal 7. The contact portion between the concave surface 721 and the terminal metal fitting 43 is formed into an annular shape, as described above. The contact portion is formed into an annular shape through multiple-point contact, linear contact, or the like. In multiple-point contact, the contact portion is intermittently formed in the circumferential direction CR. In linear contact, the contact portion is continuously formed in a circular shape.

Figure 13:
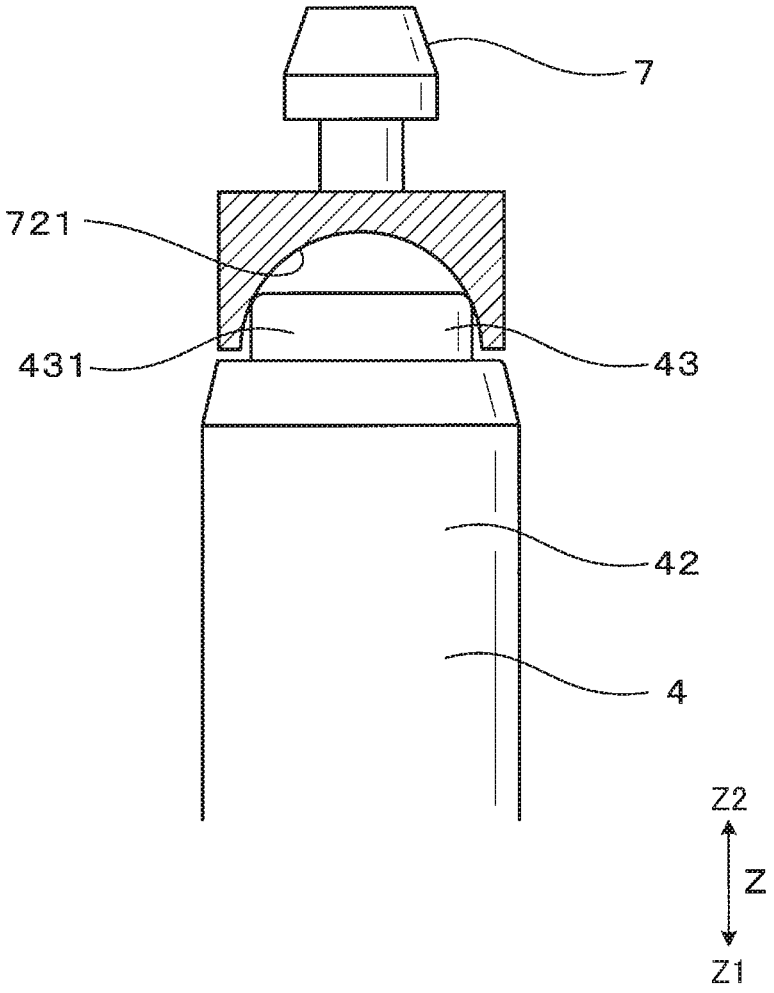
FIG. 13 is a partial cross-sectional front view of the conductive terminal and a proximal end portion of the spark plug in a first variation example according to the first embodiment.

Here, for example, as shown in FIG. 13, the protruding terminal portion 431 may be formed into a circular columnar shape that is low in height. In this case, an outer diameter of a portion of the protruding terminal portion 431 that is arranged inside the concave surface 721 is smaller than the outer diameter D2 of the open end of the concave surface 721.

Figure 14:
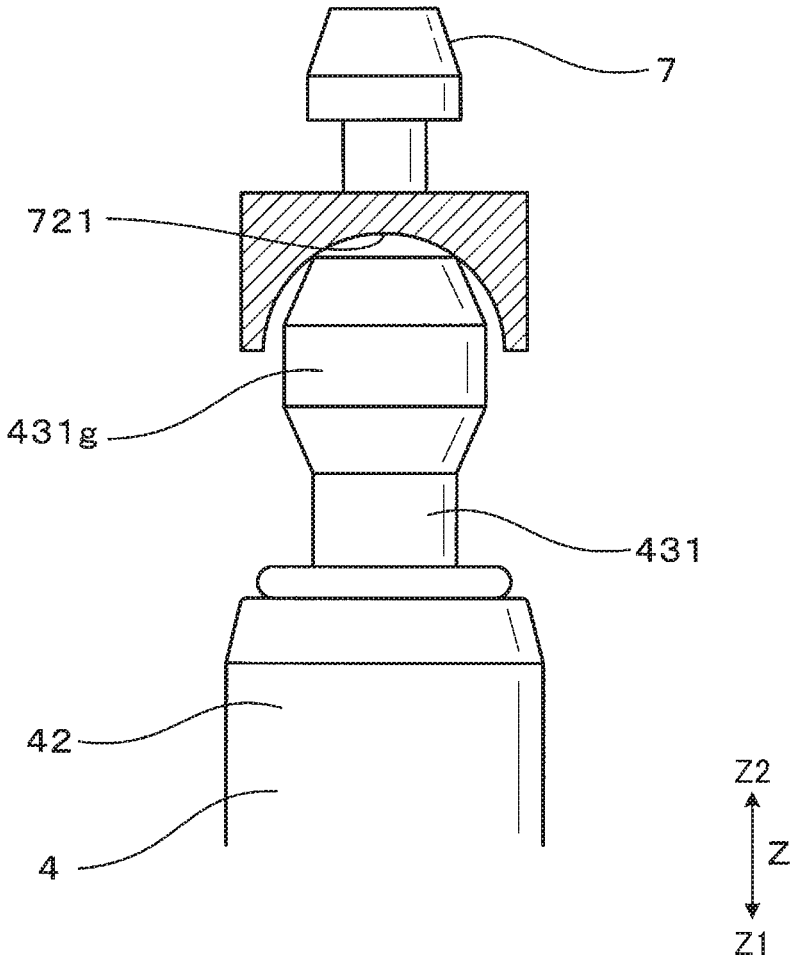
FIG. 14 is a partial cross-sectional front view of the conductive terminal and the proximal end portion of the spark plug in a second variation example according to the first embodiment.

In addition, for example, as shown in FIG. 14, the protruding terminal portion 431 may have a shape in which a proximal end portion 431*g* of the protruding terminal portion 431 swells toward the outer circumferential side (radially outwards). A center portion of the proximal end portion 431*g* of the protruding terminal portion 431 in the axial direction Z is formed into a circular columnar shape that is parallel to the axial direction Z. Both end portions of the proximal end portion 431*g* in the axial direction Z are formed into truncated conical shapes that decrease in diameter away from the center portion in the axial direction Z. In this case as well, the outer diameter of the portion of the protruding terminal portion 431 arranged inside the concave surface 721 is smaller than the outer diameter D2 of the open end of the concave surface 721. In the configuration shown in FIG. 14, a maximum diameter of the portion that is formed so as to swell toward the outer circumferential side (radially outwards) on the proximal end side Z2 of the protruding terminal portion 431 is smaller than the outer diameter D2 of the open end of the concave surface 721.

Next, aspects of the spark plug 4 being assembled to the ignition coil 1 will be described.

Figure 7:
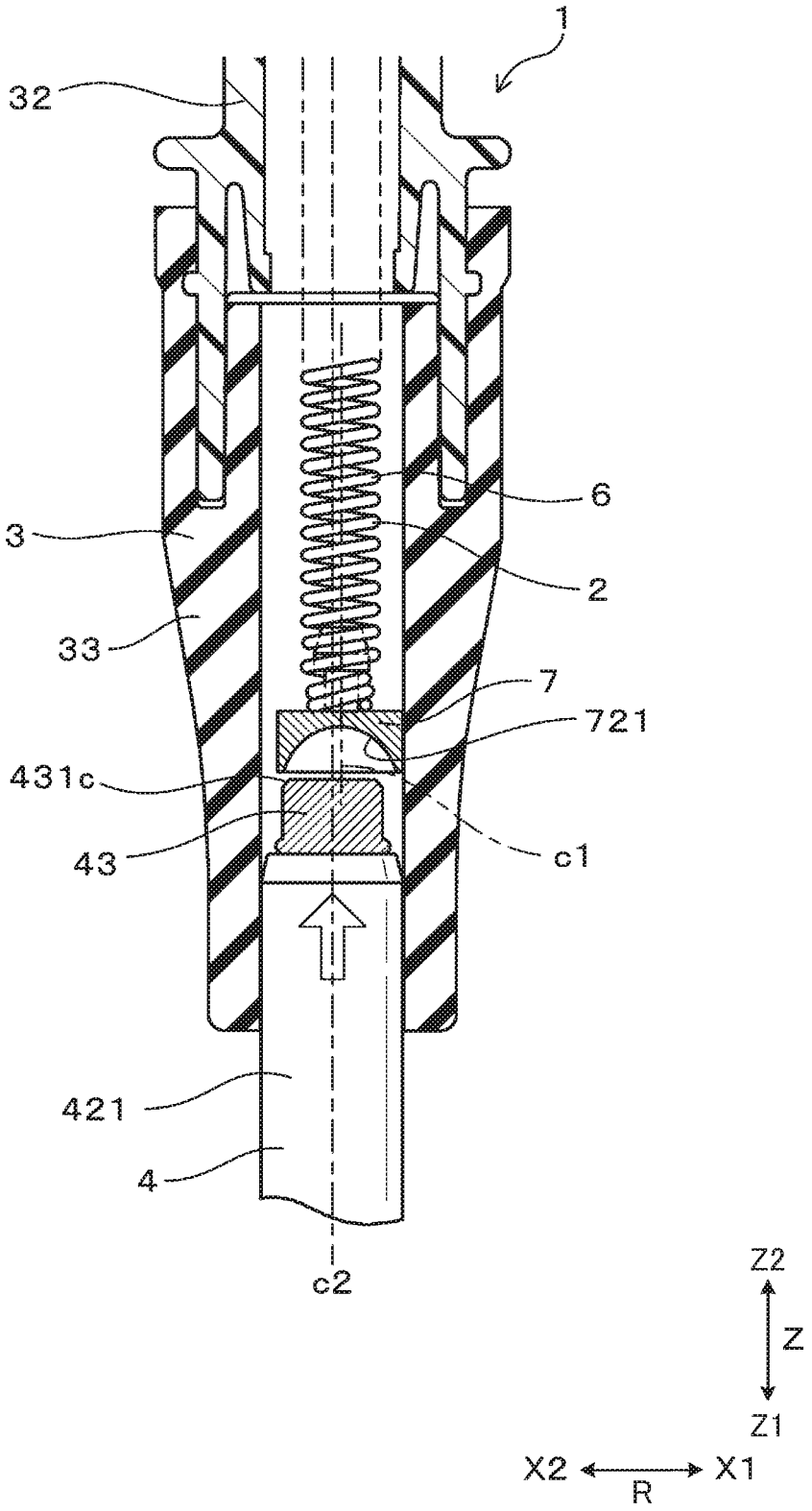
FIG. 7 is a partial cross-sectional front view of an aspect of the spark plug being assembled to the ignition coil in which a coil spring and the conductive terminal are eccentric in a radial direction relative to a protective portion, showing a state in which a terminal metal fitting and the conductive terminal are not in contact, according to the first embodiment.

First, as shown in FIG. 7, a case in which a center axis c1 of the coil spring 6 and the conductive terminal 7 of the conductive member 2 is shifted in the radial direction R relative to a center axis c2 of the protective portion 3, in a state before the spark plug 4 is assembled to the ignition coil 1, is assumed. That is, a case in which the coil spring 6 and the conductive terminal 7 are assembled so as to be eccentric toward one side in the radial direction R relative to the protective portion 3 is assumed. Here, one side in the radial direction R that is the side toward which the coil spring 6 and the conductive terminal 7 are eccentric relative to the protective portion 3 is referred to as an eccentric side X1. A side opposite the eccentric side X1 is an anti-eccentric side X2.

Figure 8:
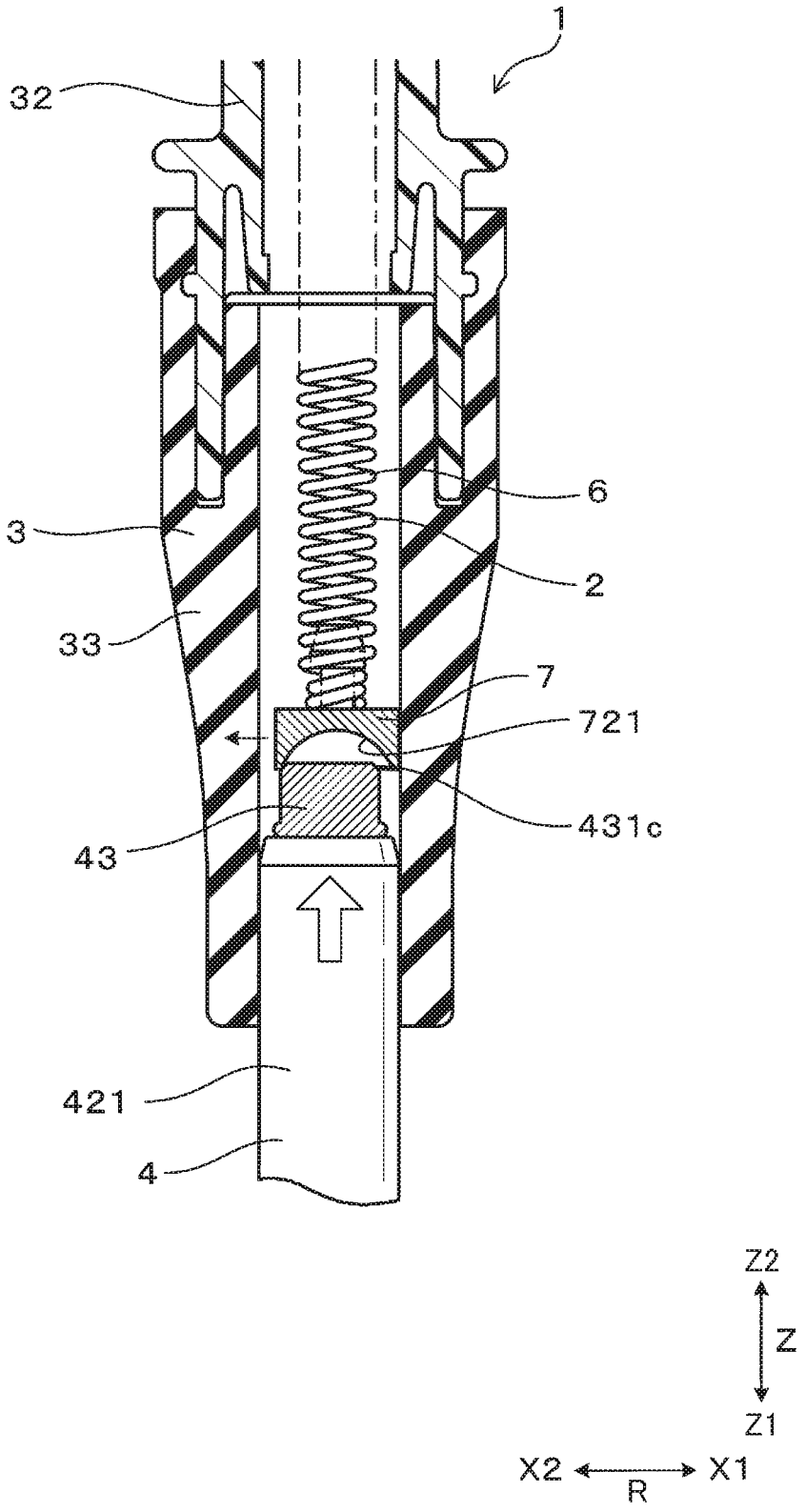
FIG. 8 is a partial cross-sectional front view of an aspect of the spark plug being assembled to the ignition coil in which the coil spring and the conductive terminal are eccentric in the radial direction relative to the protective portion, showing a state in which the terminal metal fitting and the conductive terminal are in contact, according to the first embodiment.
Figure 9:
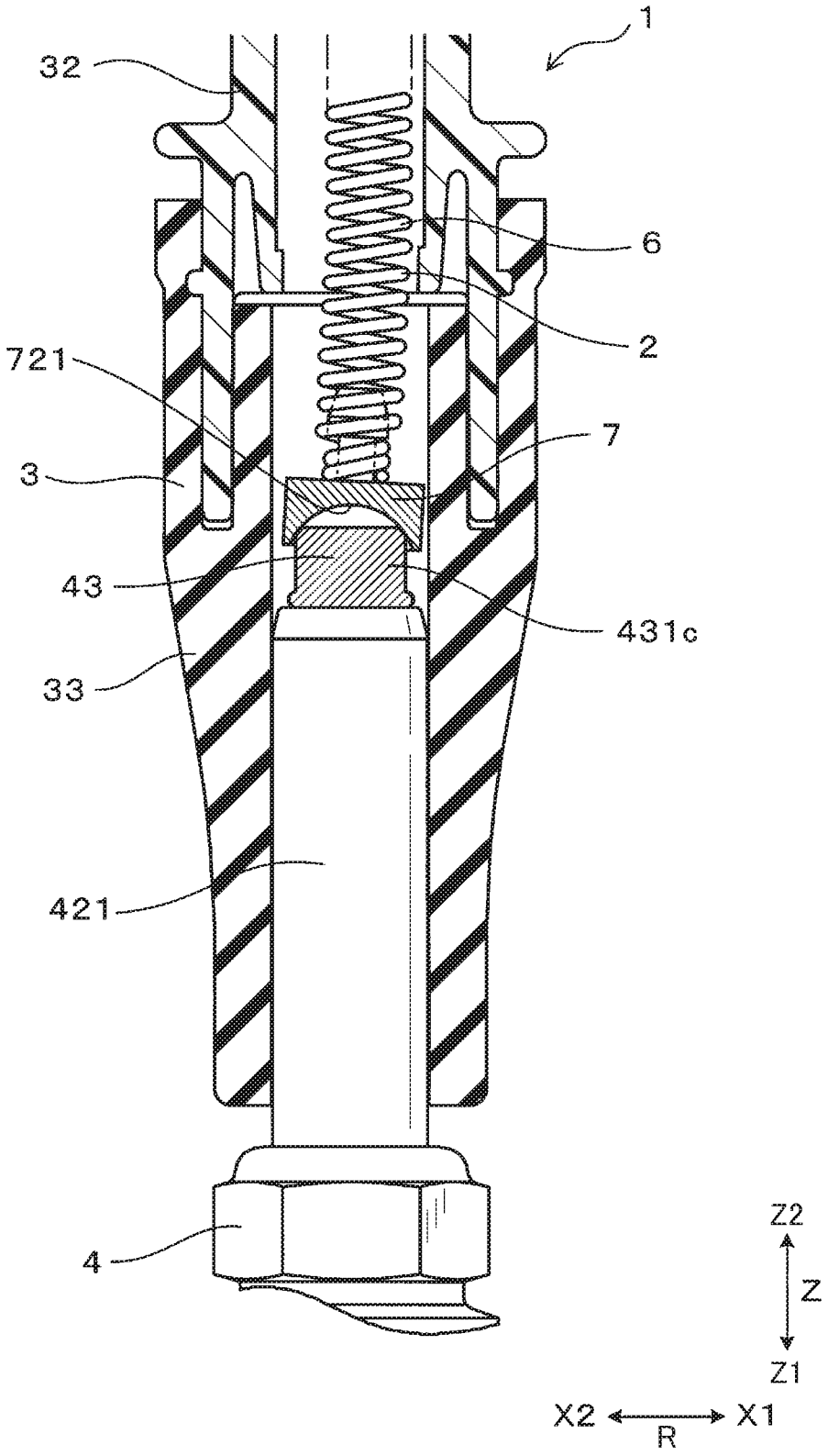
FIG. 9 is a partial cross-sectional front view of an aspect of the spark plug being assembled to the ignition coil in which the coil spring and the conductive terminal are eccentric in the radial direction relative to the protective portion, showing a state in which the spark plug is assembled to the ignition coil, according to the first embodiment.

When the insulator head portion 421 of the spark plug 4 is inserted into the plug cap 33 of the ignition coil 1 from the distal end of the plug cap 33, first, the terminal corner portion 431*c* of the terminal metal fitting 43 is inserted inside the conductive terminal 7. As shown in FIG. 8, a portion of the terminal corner portion 431*c* on the anti-eccentric side X2 abuts on a portion of the concave surface 721 of the conductive terminal 7 on the anti-eccentric side X2. In addition, when the insertion of the spark plug 4 into the plug cap 33 further progresses, the coil spring 6 is compressed in the axial direction Z, while the conductive terminal 7 is pressed by the terminal metal fitting 43 and moved toward the proximal end side Z2. At the same time, the concave surface 721 of the conductive terminal 7 slides over the surface of the terminal corner portion 431*c* of the terminal metal fitting 43. The conductive terminal 7 moves toward the anti-eccentric side X2. As shown in FIG. 9, the concave surface 721 of the conductive terminal 7 and the terminal corner portion 431*c* of the terminal metal fitting 43 are in contact in an annular shape.

In addition, in the state in which the spark plug 4 is assembled to the ignition coil 1, compared to the state before assembly, the amount of eccentricity between the center axis c1 of the coil spring 6 and the conductive terminal 7, and the center axis c2 of the protective portion 3 is reduced. That is, as a result of the spark plug 4 being assembled to the ignition coil 1, the center axis c1 of the coil spring 6 and the conductive terminal 7 is adjusted so as to align with the center axis c2 of the protective portion 3.

Figure 10:
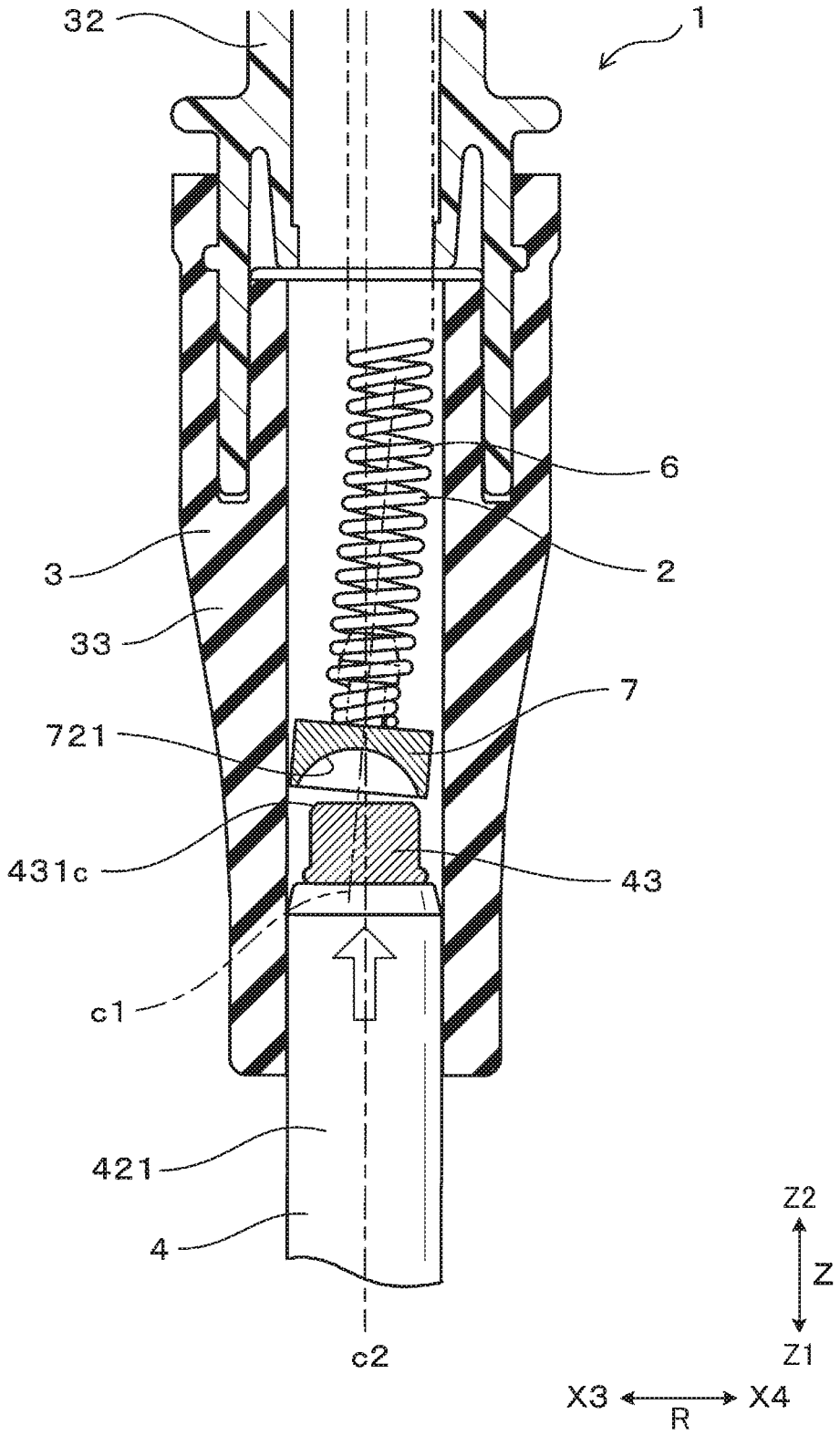
FIG. 10 is a partial cross-sectional front view of an aspect of the spark plug being assembled to the ignition coil in which a center axis of the coil spring and the conductive terminal is tilted relative to a center axis of the protective portion, showing a state in which the terminal metal fitting and the conductive terminal are not in contact, according to the first embodiment.

Next, as shown in FIG. 10, a case in which the center axis c1 of the coil spring 6 and the conductive terminal 7 of the conductive member 2 is tilted relative to the center axis c2 of the protective portion 3 is assumed. Here, the center axis c1 of the coil spring 6 and the conductive terminal 7 of the conductive member 2 is tilted further toward a tilting side X3 toward the distal end side Z1. The tilting side X3 is one side in the radial direction R. In addition, a side opposite the tilting side X3 in the radial direction R is an anti-tilting side X4.

Figure 11:
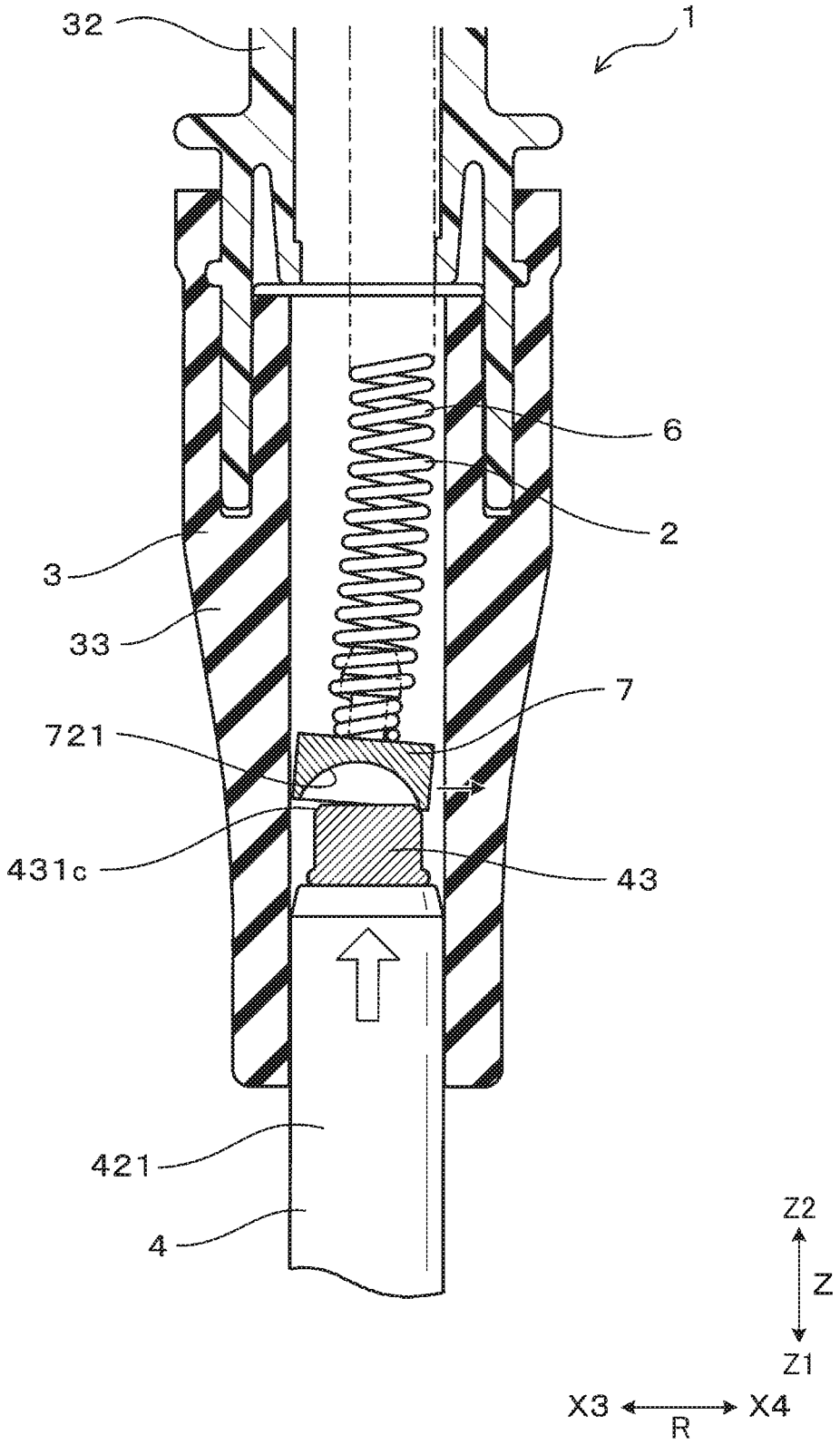
FIG. 11 is a partial cross-sectional front view of an aspect of the spark plug being assembled to the ignition coil in which the center axis of the coil spring and the conductive terminal is tilted relative to the center axis of the protective portion, showing a state in which the terminal metal fitting and the conductive terminal are in contact, according to the first embodiment.
Figure 12:
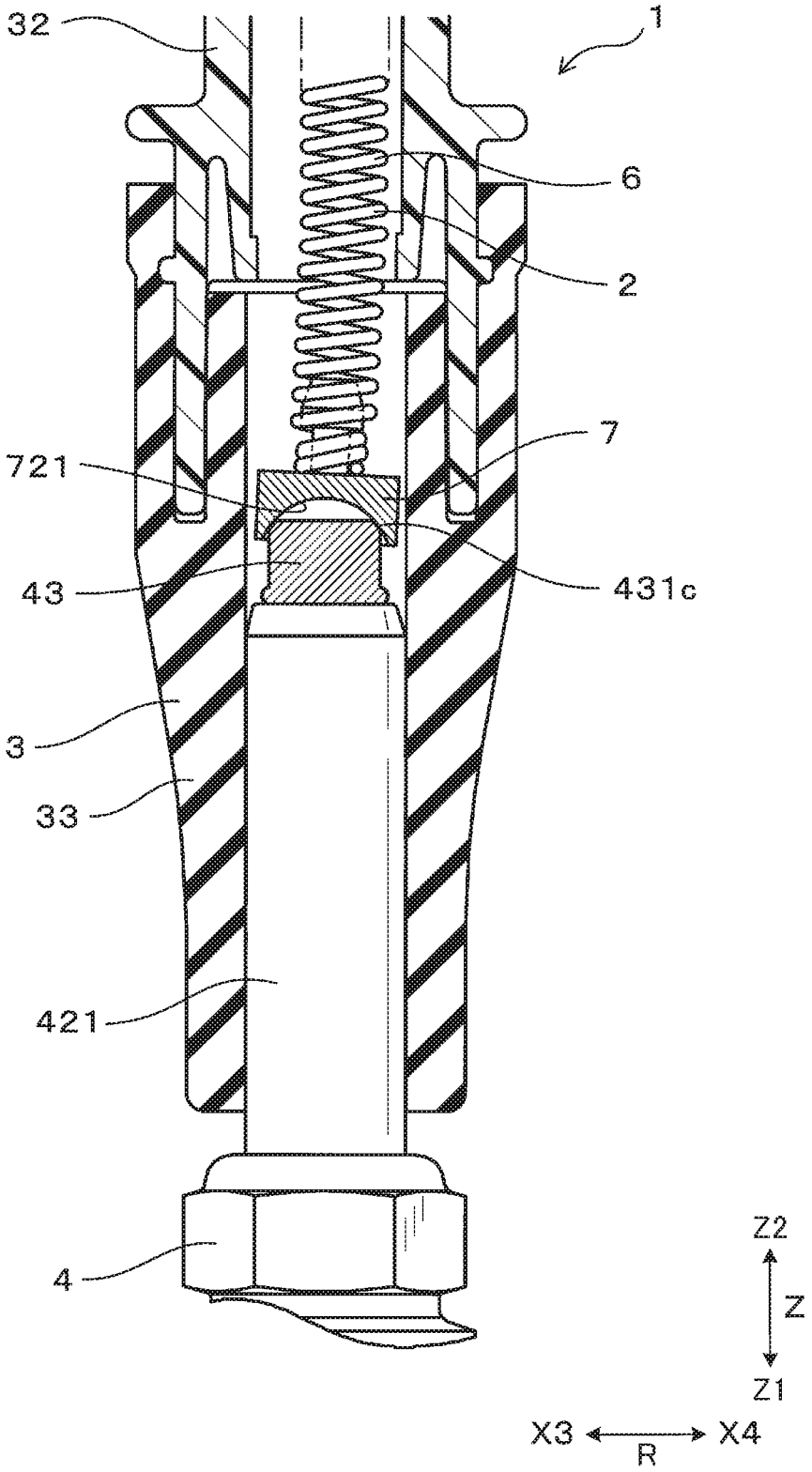
FIG. 12 is a partial cross-sectional front view of an aspect of the spark plug being assembled to the ignition coil in which the center axis of the coil spring and the conductive terminal is tilted relative to the center axis of the protective portion, showing a state in which the spark plug is assembled to the ignition coil, according to the first embodiment.

In this case, when the insulator head portion 421 of the spark plug 4 is inserted into the plug cap 33 of the ignition coil 1 from the distal end of the plug cap 33, first, as shown in FIG. 11, the terminal corner portion 431*c* of the terminal metal fitting 43 is inserted inside the conductive terminal 7. The terminal corner portion 431*c* abuts on a portion of the concave surface 721 of the conductive terminal 7 on the anti-tilting side X4. Then, when insertion of the spark plug 4 into the plug cap 33 further progresses, the coil spring 6 is compressed in the axial direction Z while the conductive terminal 7 is pressed toward the proximal end side Z2 by the terminal metal fitting 43 and moved toward the proximal end side Z2. At the same time, the concave surface 721 of the conductive terminal 7 slides over the surface of the terminal corner portion 431*c* of the terminal metal fitting 43 and moves toward the anti-tilting side X4. In addition, the concave surface 721 rotates around the contact portion between the concave surface 721 and the terminal metal fitting 43 (that is, the portion of the concave surface 721 on the anti-tilting side X4). As shown in FIG. 12, the concave surface 721 and the terminal corner portion 431*c* of the terminal metal fitting 43 are in contact in an annular shape.

In addition, in the state in which the spark plug 4 is assembled to the ignition coil 1, compared to the state before assembly, an angle of tilting of the center axis c1 of the coil spring 6 and the conductive terminal 7 relative to the center axis c2 of the protective portion 3 is reduced. That is, as a result of the spark plug 4 being assembled to the ignition coil 1, the tilt of the center axis c1 of the coil spring 6 and the conductive terminal 7 is corrected such that the center axis c1 runs along the axial direction Z.

Next, effects according to the present embodiment will be described.

In the ignition coil 1 according to the present embodiment, the conductive terminal 7 is attached to the distal end of the coil spring 6. In addition, the distal end surface of the conductive terminal 7 has the concave surface 721 that is recessed toward the proximal end side Z2 toward the inner circumferential side. The concave surface 721 abuts on the terminal metal fitting 43 of the spark plug 4. In addition, the distal end surface of the conductive terminal 7 is configured such that the contact portion with the terminal metal fitting 43 of the spark plug 4 is formed into an annular shape. Therefore, contact area between the concave surface 721 and the terminal metal fitting 43 of the spark plug 4 can be increased. Reliability of electrical connection between the conductive member 2 and the terminal metal fitting 43 of the spark plug 4 can be easily ensured.

In addition, the concave surface 721 is formed so as to curve toward the inner circumferential side toward the proximal end side Z2. Therefore, even in cases in which the center axis of the conductive member 2 is eccentric or tilted relative to the center axis of the protective portion 3, as described above, the eccentricity or tilting is corrected.

In addition, the conductive terminal 7 that abuts on the terminal metal fitting 43 of the spark plug 4 is configured as a separate component from the coil spring 6. Therefore, the conductive terminal 7 may be composed of a material that takes into consideration resistance to abrasion against the terminal metal fitting 43. Alternatively, abrasion-resistance between the conductive terminal 7 and the terminal metal fitting 43 may be ensured by a surface treatment being performed on the conductive terminal 7. For example, as a result of the material of the conductive terminal 7 differing from that of the terminal metal fitting 43 with which the conductive terminal 7 is in contact, abrasion-resistance between the conductive terminal 7 and the terminal metal fitting 43 can be improved.

In addition, the concave surface 721 is formed into a spherical surface. Therefore, even if the conductive member 2 is eccentric or tilted to any side in the circumferential direction CR relative to the center axis of the protective portion 3, the eccentricity or tilting can be corrected as a result of the spark plug 4 being assembled to the ignition coil 1.

In addition, the conductive terminal 7 includes the small diameter portion 711. The outer shape of the small diameter portion 711 when viewed in the axial direction Z is smaller than that of the portion that is adjacent on the proximal end side Z2. The distal end portion of the coil spring 6 is wound around the small diameter portion 711 by a single turn or more. Therefore, the conductive terminal 7 can be easily fixed to the coil spring 6.

As described above, according to the present embodiment, the ignition coil that is capable of improving connection reliability between the conductive member and the terminal metal fitting of the spark plug can be provided.

Second Embodiment

Figure 15:
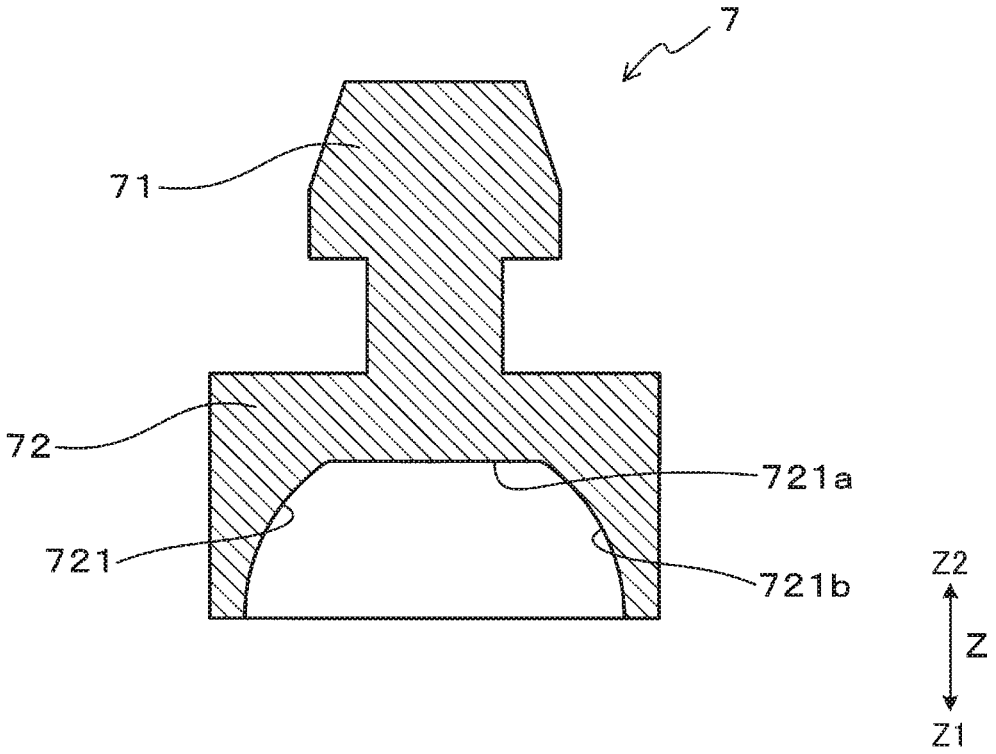
FIG. 15 is a cross-sectional view of a conductive terminal according to a second embodiment.

As shown in FIG. 15, according to a second embodiment, the shape of the concave surface 721 of the conductive terminal 7 is changed from that according to the first embodiment.

The concave portion 721 according to the present embodiment includes a concave top surface 721*a* and a concave side surface 721*b*. The concave top surface 721*a* is formed into a planar shape that is orthogonal to the axial direction Z, so as to face the distal end side Z1. The concave side surface 721*b* extends toward the distal end side Z1 from the overall circumference of the concave top surface 721*a*. The concave side surface 721*b* curves toward the inner circumferential side toward the proximal end side Z2 (that is, the concave top surface 721*a* side). The concave side surface 721*b* is curved so as to swell toward the outer circumferential side in the radial direction R. In addition, in a state in which the spark plug 4 is assembled to the ignition coil 1, the concave side surface 721*b* and the terminal corner portion 431*c* of the terminal metal fitting 43 are in contact in an annular shape.

Other configurations are similar to those according to the first embodiment.

Here, among reference numbers used according to the second and subsequent embodiments, reference numbers that are identical to those used according to a previous embodiment indicate constituent elements and the like that are similar to those according to the previous embodiments unless particularly stated otherwise.

According to the present embodiment as well, effects similar to those according to the first embodiment can be obtained.

Third Embodiment

Figure 16:
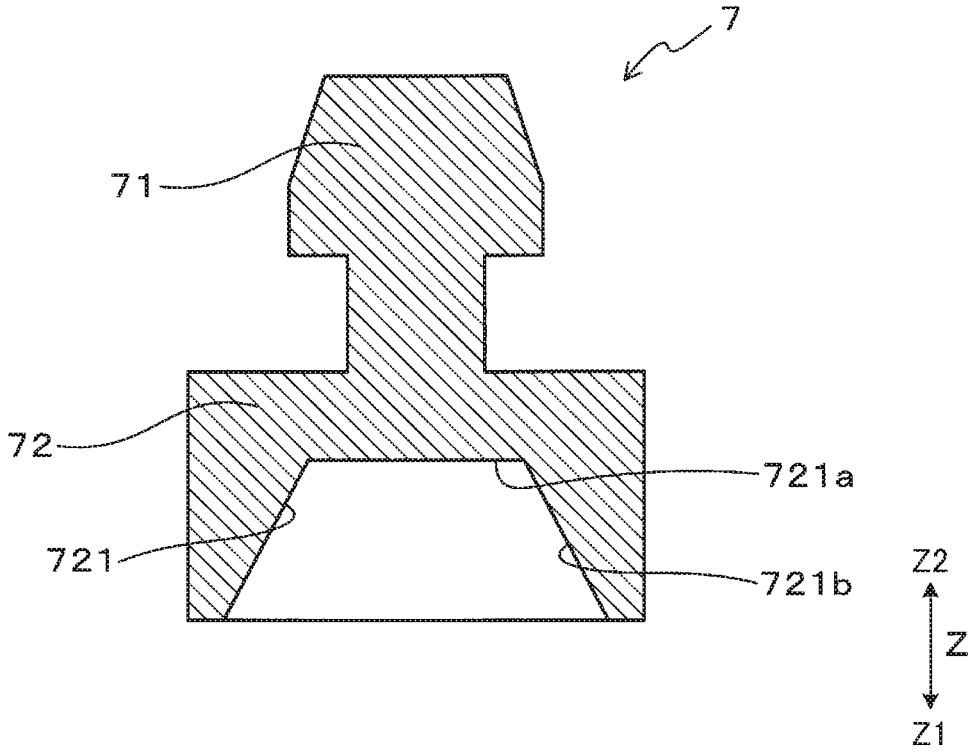
FIG. 16 is a cross-sectional view of a conductive terminal according to a third embodiment.

As shown in FIG. 16, according to a third embodiment, the shape of the concave side surface 721*b* is changed from that according to the second embodiment.

According to the present embodiment, the concave side surface 721*b* is formed into a tapered shape that tapers toward the inner circumferential side (radially inward) toward the proximal end side Z2. That is, the concave side surface 721*b* has a linear shape on a cross-section that passes through the center axis of the conductive terminal 7 and is parallel to the center axis.

Other configurations are similar to those according to the second embodiment.

According to the present embodiment as well, effects similar to those according to the second embodiment can be obtained.

Fourth Embodiment

Figure 17:
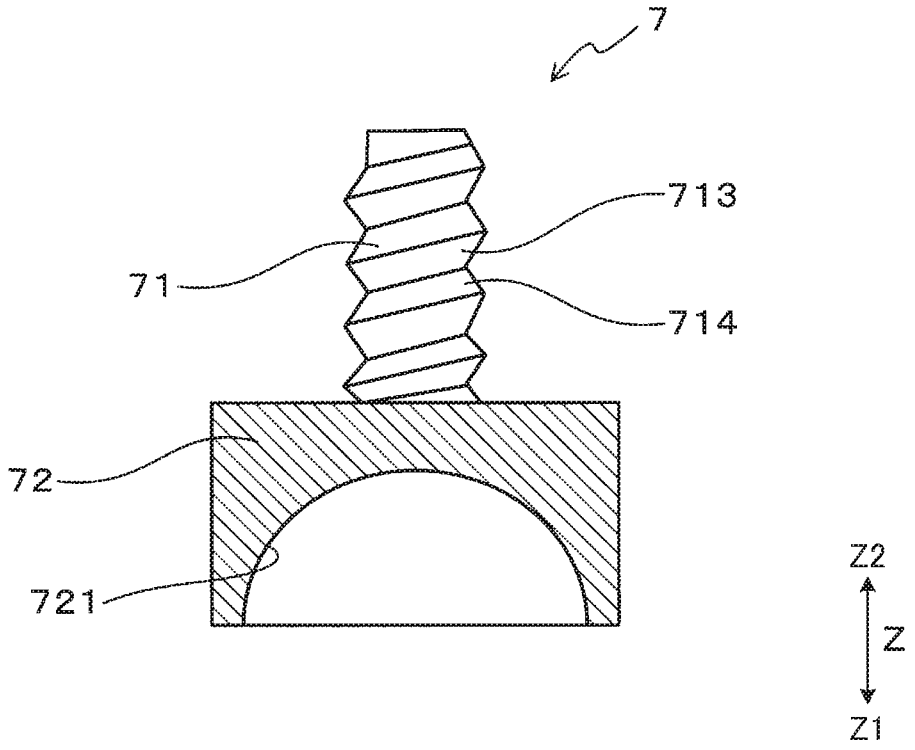
FIG. 17 is a partial cross-sectional front view of a conductive terminal according to a fourth embodiment.

As shown in FIG. 17, according to a fourth embodiment, the shape of the spring connecting portion 71 of the conductive terminal 7 is changed from that according to the first embodiment.

According to the present embodiment, a helical thread portion 713 is provided in the outer circumferential portion of the spring connecting portion 71. In addition, in the spring connecting portion 71, the thread portion 713 configures the large diameter portion 712. A valley portion 714 between adjacent thread portions 713 in the axial direction Z configures the small diameter portion 711. That is, according to the present embodiment, the small diameter portion 711 is formed into a helical shape. In addition, according to the present embodiment as well, the distal end portion of the coil spring 6 is wound around the small diameter portion 711.

Other configurations are similar to those according to the first embodiment.

According to the present embodiment as well, effects similar to those according to the first embodiment can be obtained.

Fifth Embodiment

Figure 18:
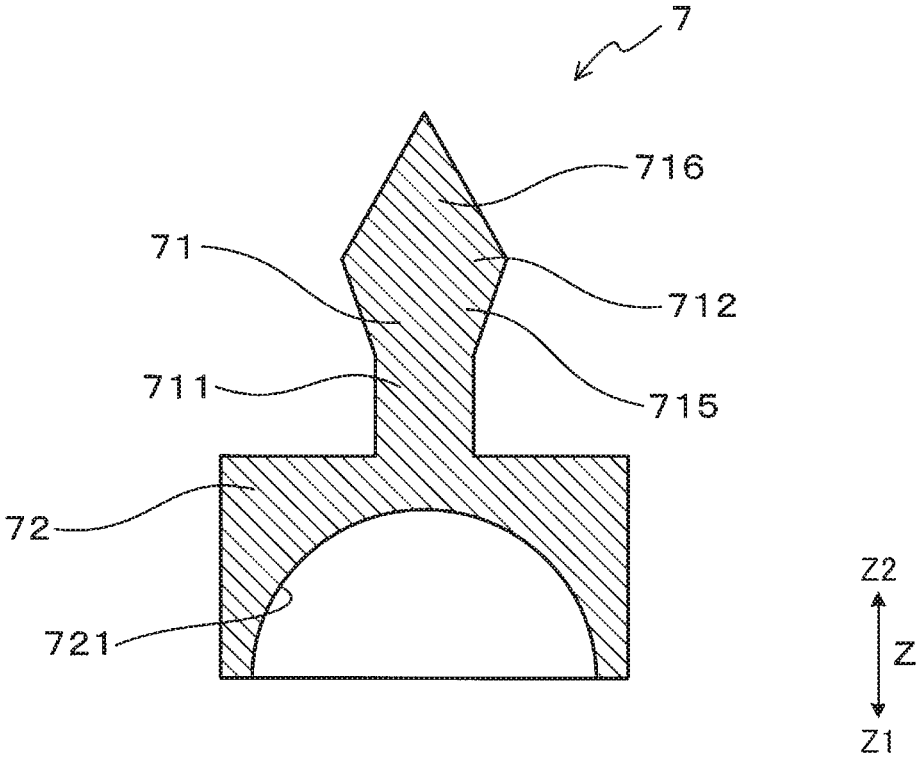
FIG. 18 is a cross-sectional view of a conductive terminal according to a fifth embodiment.

As shown in FIG. 18, according to a fifth embodiment, the shape of the large diameter portion 712 of the spring connecting portion 71 is changed from that according to the first embodiment.

The large diameter portion 712 includes a first portion 715 and a second portion 716. The first portion 715 is formed from the small diameter portion 711 toward the proximal end side Z2. The first portion 715 is formed into a truncated conical shape that increases in diameter toward the proximal end side Z2. In addition, the second portion 716 is formed into a conical shape that decreases in diameter toward the proximal end side Z2. Furthermore, the maximum diameter of the large diameter portion 712 is at a boundary portion between the first portion 715 and the second portion 716.

Other configurations are similar to those according to the first embodiment.

According to the present embodiment as well, effects similar to those according to the first embodiment can be obtained.

Sixth Embodiment

Figure 19:
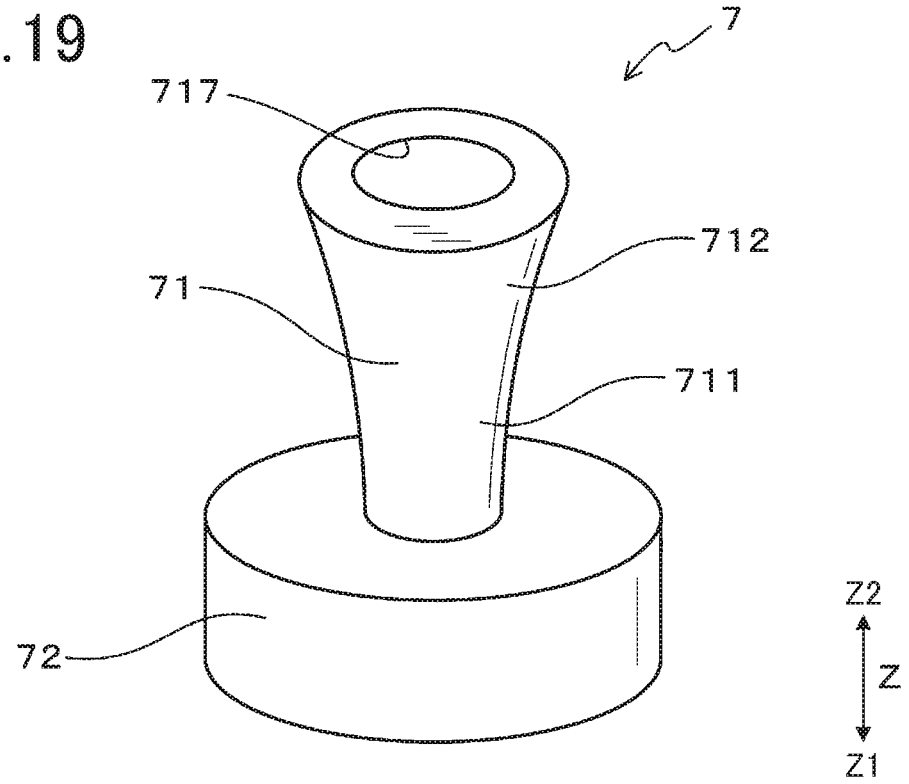
FIG. 19 is a perspective view of a conductive terminal according to a sixth embodiment.

As shown in FIG. 19, according to a sixth embodiment, the shape of the spring connecting portion 71 is changed from that according to the first embodiment.

According to the present embodiment, an outer circumferential surface of the spring connecting portion 71 has a trumpet-like shape that increases in diameter toward the proximal end side Z2. A distal end portion of the spring connecting portion 71 configures the small diameter portion 711. A proximal end portion of the spring connecting portion 71 configures the large diameter portion 712.

A hole portion 717 that is open toward the proximal end side Z2 is formed in the center of the spring connecting portion 71 when the spring connecting portion 71 is viewed from the proximal end side Z2. For example, the spring connecting portion 71 according to the present embodiment can be configured to have a shape such as that shown in FIG. 19 by a rod-shaped jig that has a same shape as the hole portion 717 being pressed against a center of a circular columnar member of which the diameter is fixed in the axial direction Z, and plastic deformation being performed so as to widen the circular columnar member toward the outer circumferential side.

Other configurations are similar to those according to the first embodiment.

According to the present embodiment as well, effects similar to those according to the first embodiment can be obtained.

Seventh Embodiment

Figure 20:
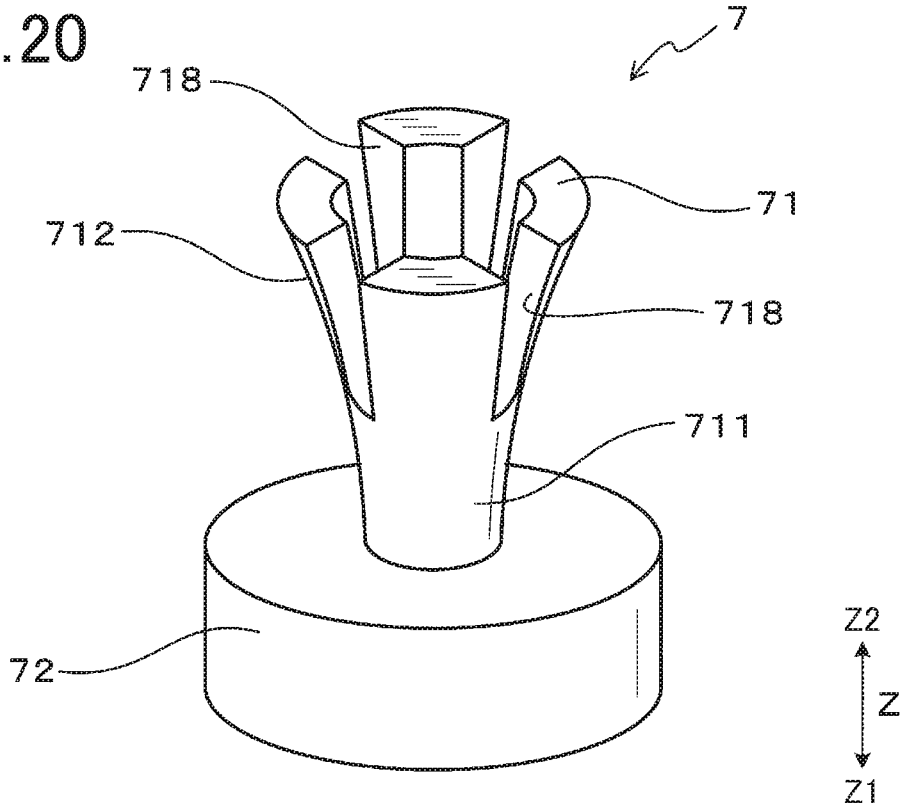
FIG. 20 is a perspective view of a conductive terminal according to a seventh embodiment.
Figure 21:
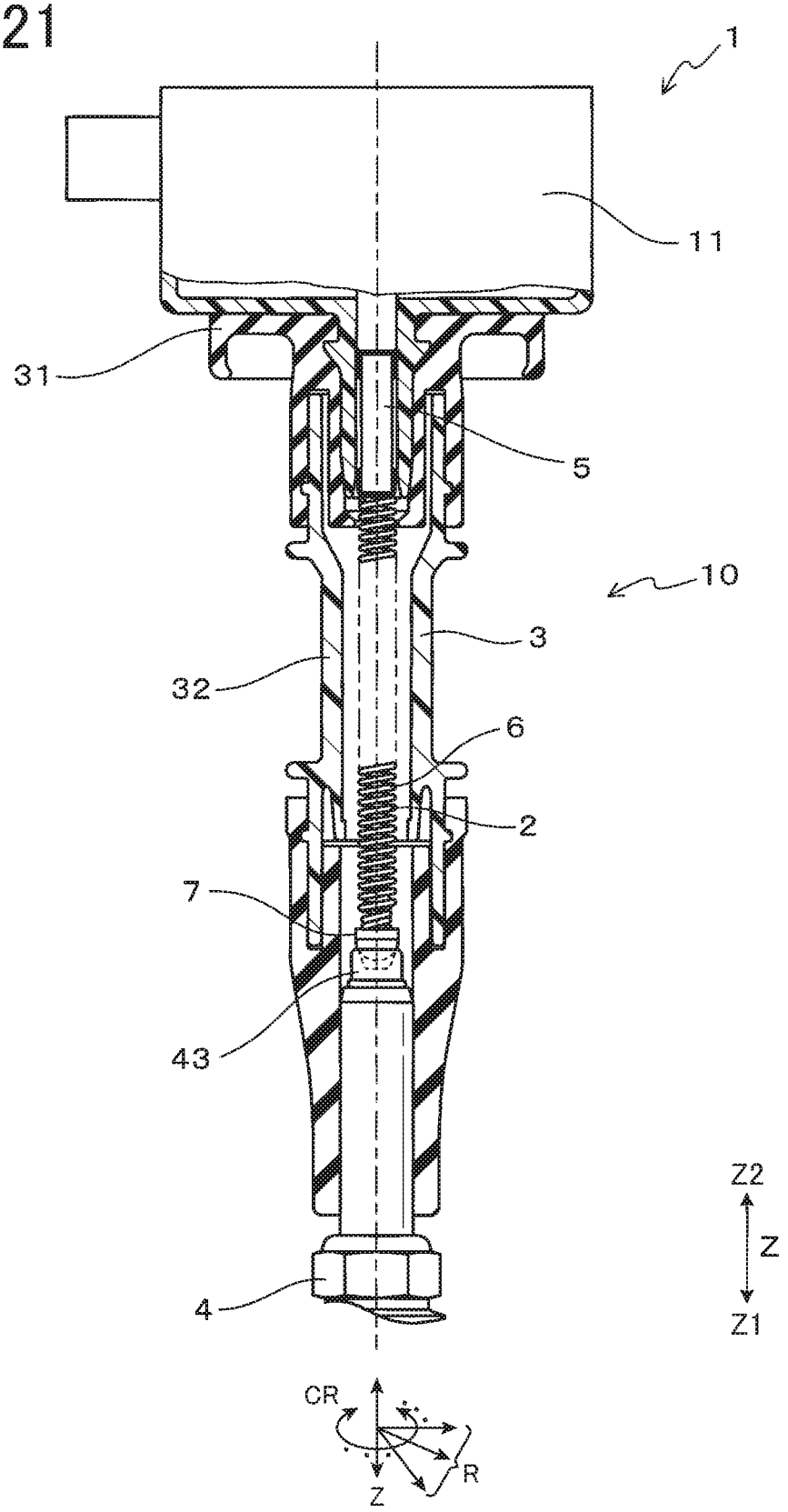
FIG. 21 is a partial cross-sectional front view of an ignition coil and a spark plug for an internal combustion engine according to an eighth embodiment.

As shown in FIG. 20, according to a seventh embodiment, the shape of large diameter portion 712 of the spring connecting portion 71 is changed from that according to the sixth embodiment.

According to the present embodiment, a groove portion 718 that divides the large diameter portion 712 in a circumferential direction CR is formed in the large diameter portion 712. The groove portion 718 is formed from the proximal end portion of the large diameter portion 712 toward the distal end side Z1. The groove portion 718 is formed by slot processing or the like.

Other configurations are similar to those according to the sixth embodiment.

According to the present embodiment, the large diameter portion 712 includes the groove portion 718. Therefore, when the large diameter portion 712 is manufactured by the rod-shaped shaft being inserted into the center of the columnar member, in the hole portion 717 of the large diameter portion 712 before processing that has a fixed outer diameter in the axial direction Z, and plastic deformation is performed to increase the diameter of the large diameter portion 712, the large diameter portion 712 can be easily increased in diameter (that is, with little force).

According to the present embodiment as well, effects similar to those according to the sixth embodiment can be obtained.

Eighth Embodiment

As shown in FIG. 21 to FIG. 34, according to an eighth embodiment, the shape of the conductive terminal 7 and the shape of the protruding terminal portion 431 of the terminal metal fitting 43 of the spark plug 4 are changed from those according to the first embodiment.

As shown in FIG. 22 to FIG. 26, according to the present embodiment, the shape of the plug connecting portion 72 in the conductive terminal 7 differs from the shape according to the first embodiment. As shown in FIG. 22 to FIG. 25, the plug connecting portion 72 includes a circular columnar portion 723 and a hemispherical portion 724. The circular columnar portion 723 is arranged on the proximal end side Z2. The hemispherical portion 724 is formed on the distal end side Z1 of the circular columnar portion 723. The hemispherical portion 724 has a hemispherical shape that decreases in diameter toward the distal end side Z1.

Figure 22:
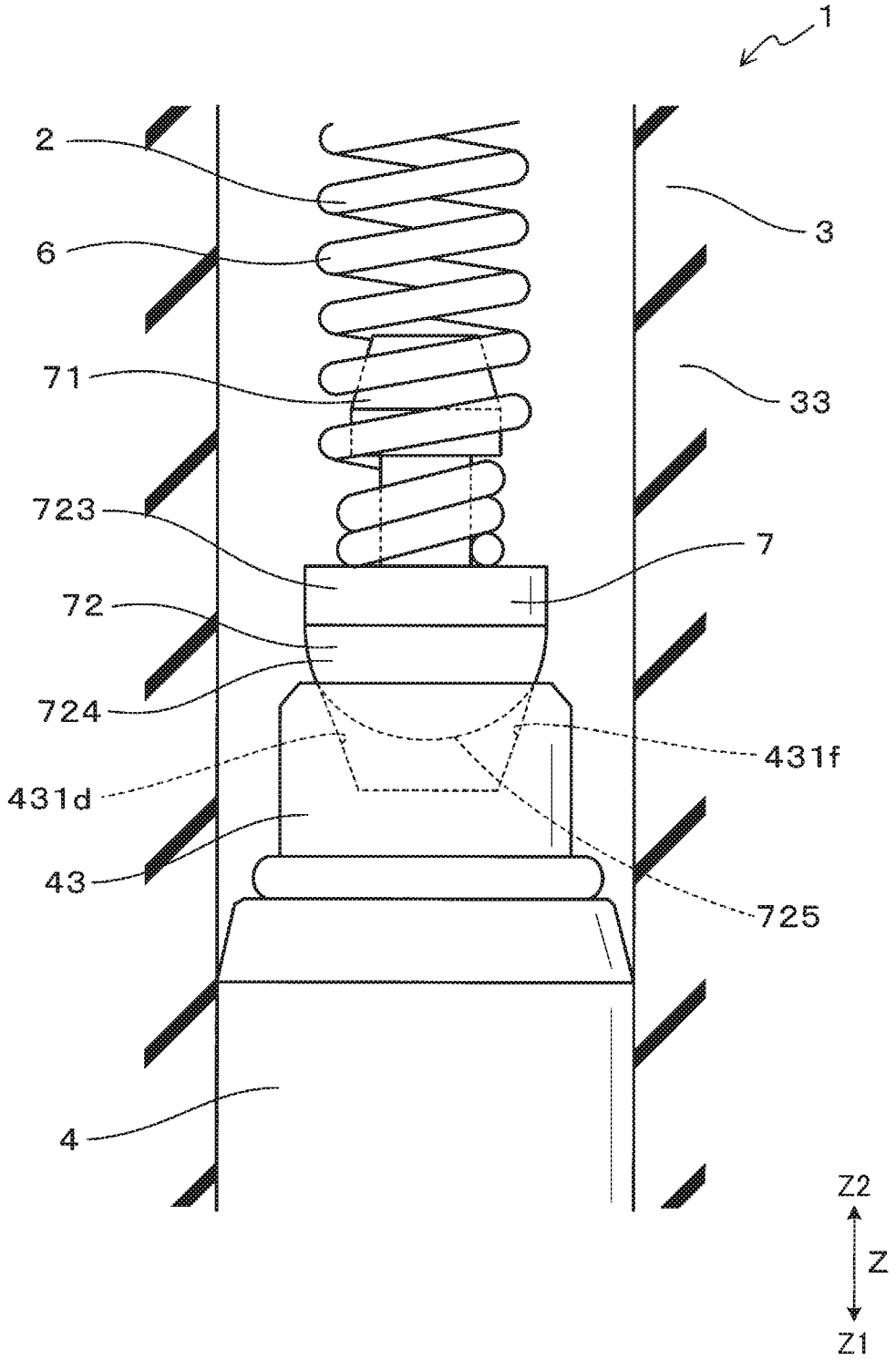
FIG. 22 is an enlarged view of a periphery of a conductive terminal in FIG. 21.
Figure 23:
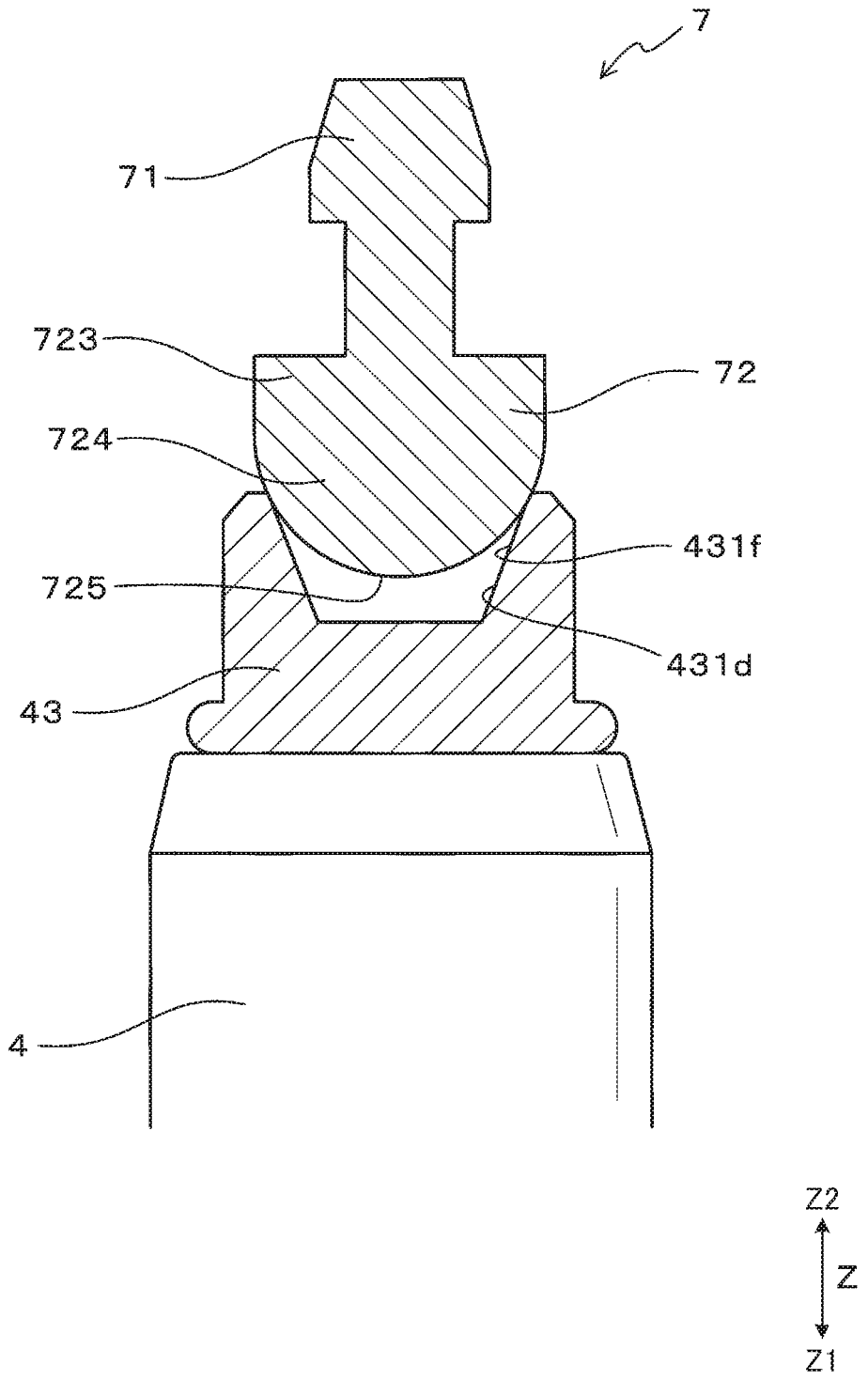
FIG. 23 is a partial cross-sectional front view of the conductive terminal and the spark plug according to the eighth embodiment.

A distal end surface of the plug connecting portion 72, that is, a surface of the hemispherical portion 724 configures a convex (protrusion) surface 725. The convex surface 725 is formed into a hemispherical surface that swells toward the distal end side Z1. That is, the convex surface 725 is formed so as to protrude toward the distal end side Z1 toward the inner circumferential side. As shown in FIG. 22 and FIG. 23, the convex surface 725 is configured so as to be inserted into a terminal concave surface 431*d* of the terminal metal fitting 43, described hereafter. According to the present embodiment as well, the conductive terminal 7 has a rotating-body shape that has rotational symmetry relative to a rotation axis that extends in the axial direction Z.

Figure 27:
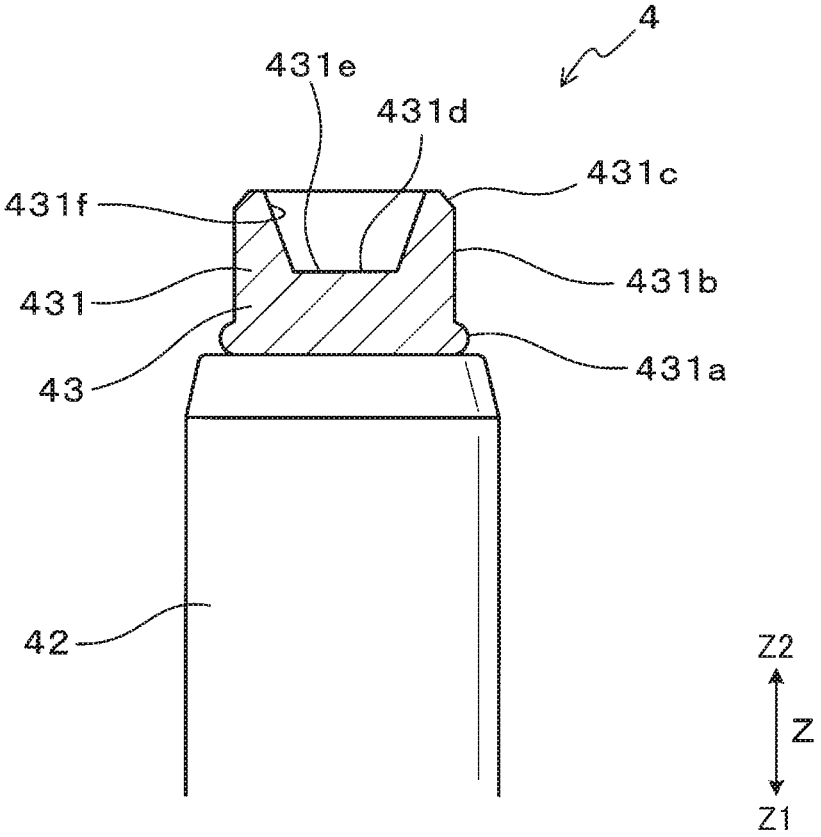
FIG. 27 is a partial cross-sectional front view of a proximal end portion of the spark plug according to the eighth embodiment.
Figure 28:
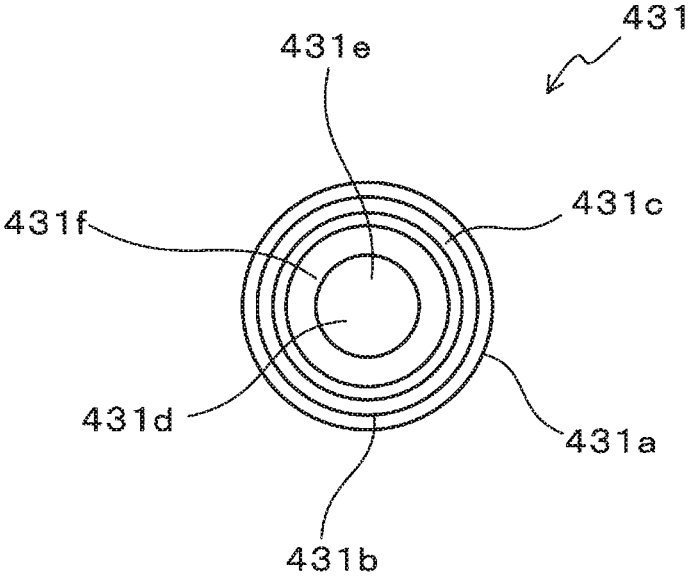
FIG. 28 is a plan view of a protruding terminal portion viewed from a proximal end side, according to the eighth embodiment.

In addition, as shown in FIG. 27 and FIG. 28, the protruding terminal portion 431 of the terminal metal fitting 43 has the terminal main body portion 431*b* and the terminal flange portion 431*a*, in a manner similar to that according to the first embodiment. The terminal main body portion 431*b* has the terminal concave surface 431*d* in which a center portion of a proximal end surface, excluding an edge thereof, is recessed toward the distal end side Z1. According to the present embodiment as well, the terminal corner portion 431*c* between the proximal end surface and the side surface of the terminal main body portion 431*b* is formed into a tapered shape that tapers toward the inner circumferential side (radially inward) toward the proximal end side Z2. The terminal concave surface 431*d* is formed further toward the inner circumferential side than the terminal corner portion 431*c*.

The terminal concave surface 431*d* includes a terminal concave bottom surface 431*e* and a terminal concave side surface 431*f*. The terminal concave bottom surface 431*e* faces the proximal end side Z2 and is formed into a plane shape that is orthogonal to the axial direction Z. The terminal concave side surface 431*f* extends toward the proximal end side Z2 from the overall circumference of the terminal concave bottom surface 431*e*. The terminal concave side surface 431*f* is formed into a tapered shape that tapers toward the inner circumferential side (radially inward) toward the distal end side Z1 (that is, the terminal concave bottom surface 431*e* side). In addition, space inside the terminal concave surface 431*d* has a truncated conical shape that decreases in diameter toward the distal end side Z1. Furthermore, according to the present embodiment as well, the protruding terminal portion 431 of the terminal metal fitting 43 has a rotating-body shape that has rotational symmetry relative to a rotation axis that extends in the axial direction Z.

Figure 24:
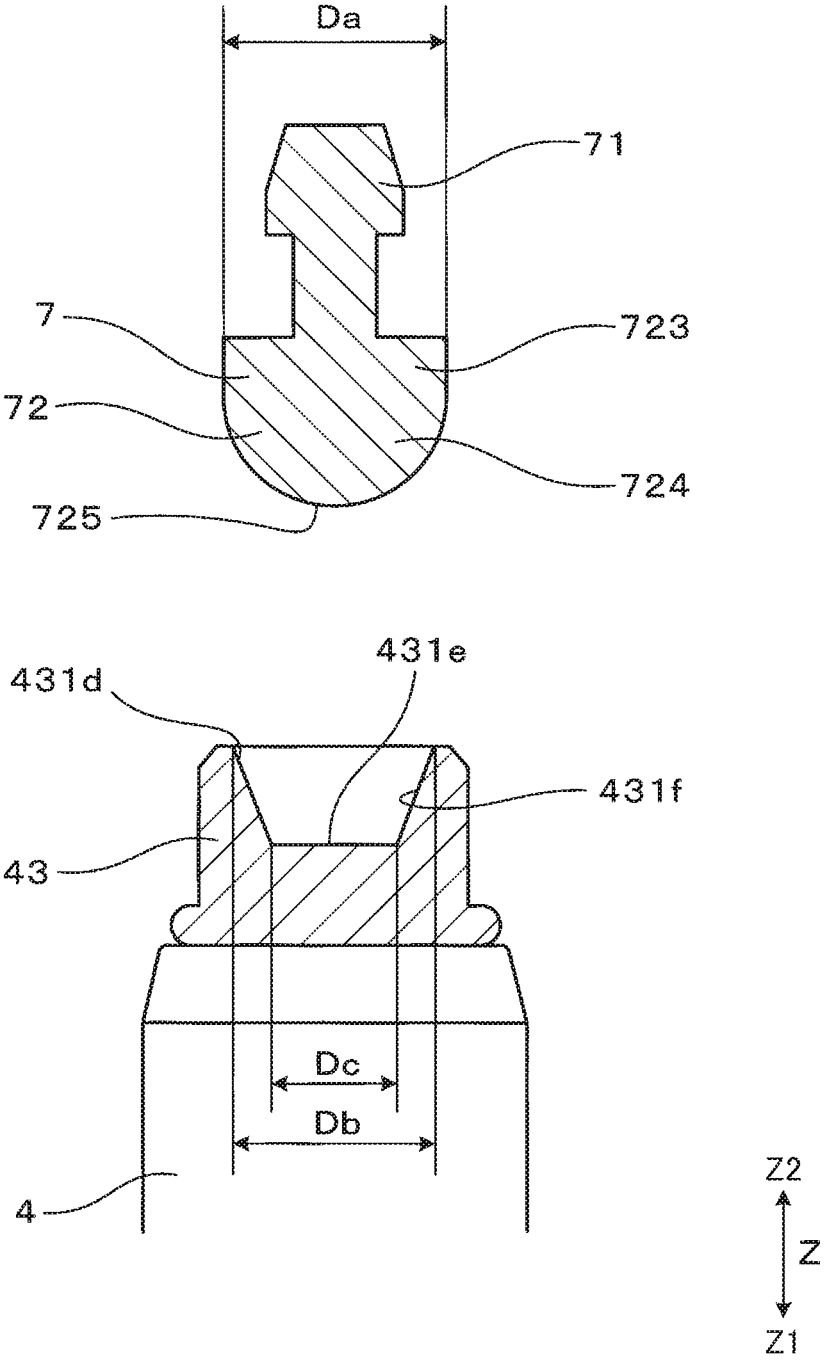
FIG. 24 is a diagram in which the conductive terminal and the spark plug are separated, according to the eighth embodiment.
Figure 25:
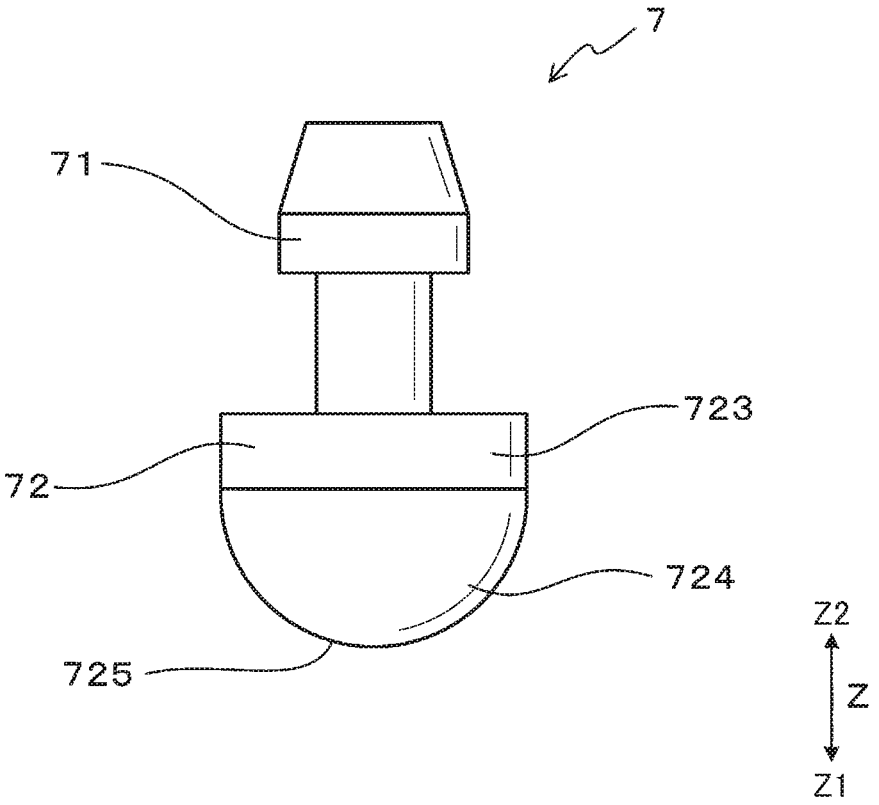
FIG. 25 is a front view of the conductive terminal according to the eighth embodiment.
Figure 26:
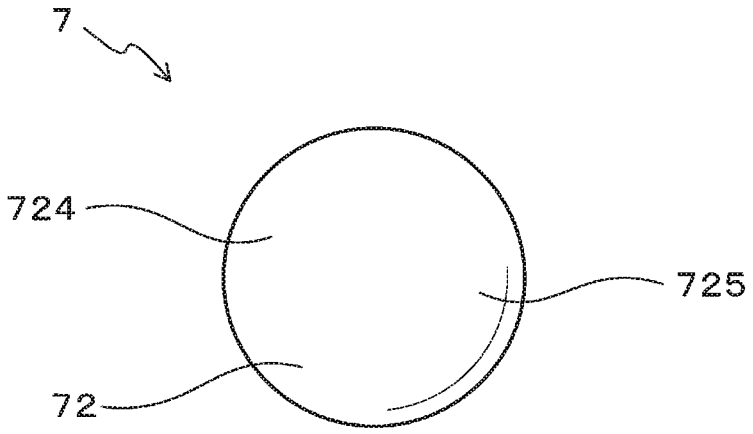
FIG. 26 is a bottom view of the conductive terminal viewed from a distal end side, according to the eighth embodiment.

Here, as shown in FIG. 24, a maximum diameter of the convex surface 725 of the conductive terminal 7 is denoted by Da. An outer diameter of the open end (that is, the proximal end-side end portion) of the terminal concave side surface 431*f* is denoted by Db. An outer diameter of the terminal concave bottom surface 431*e* of the terminal metal fitting 43 is denoted by Dc. At this time, diameters Da to Dc satisfy a relationship of Da>Db>Dc. As a result of the maximum outer diameter Da of the convex surface 725 of the conductive terminal 7 being greater than the outer diameter Db of the open end of the terminal concave side surface 431*f*, when the spark plug 4 is assembled to the ignition coil 1, the convex surface 725 of the conductive terminal 7 can abut on the terminal concave side surface 431*f*.

As shown in FIG. 22, in a state in which the spark plug 4 is assembled to the ignition coil 1, the terminal concave side surface 431*f* of the terminal metal fitting 43 abuts on the convex surface 725 of the conductive terminal 7. A contact portion between the convex surface 725 and the terminal concave side surface 431*f* has an annular shape.

Next, aspects of the spark plug 4 being assembled to the ignition coil 1 will be described.

Figure 29:
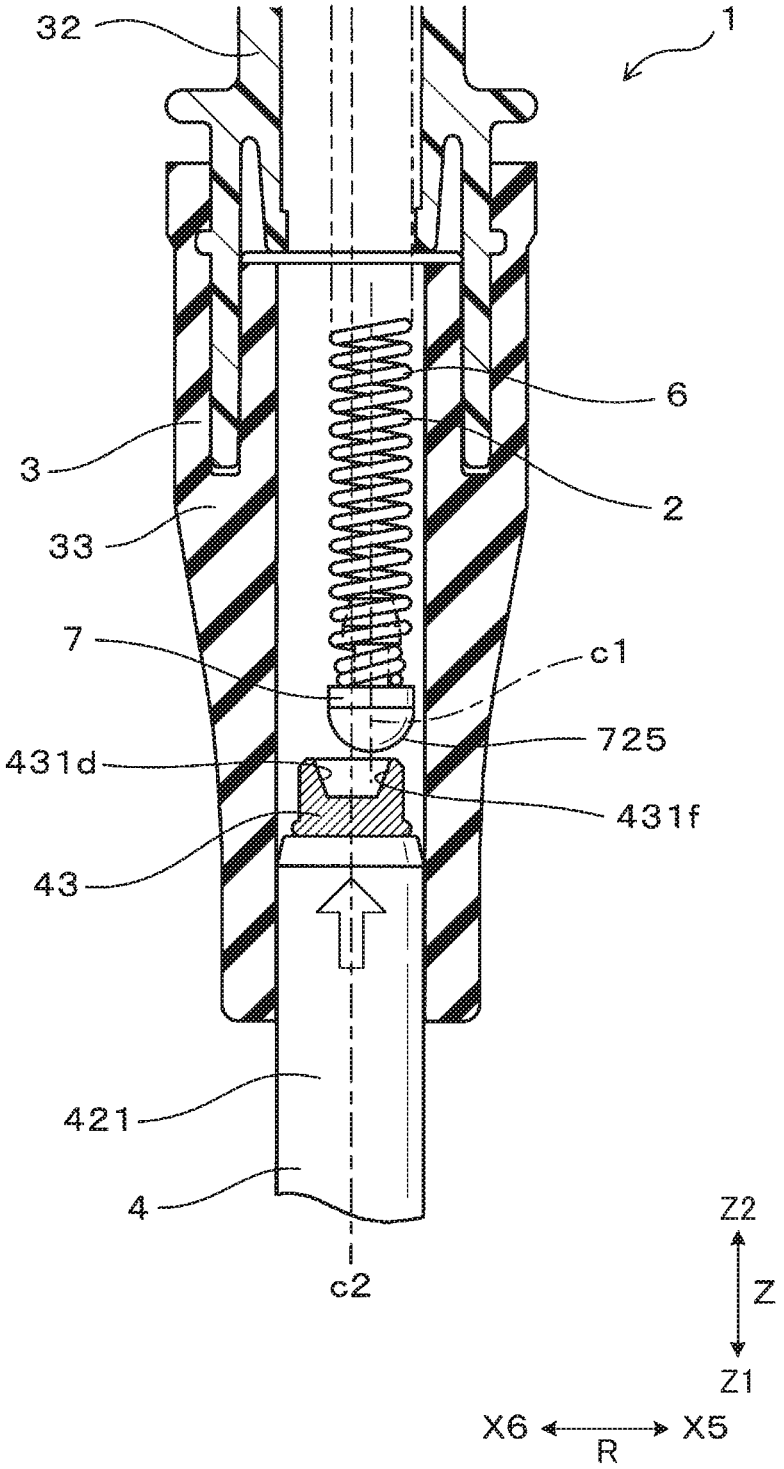
FIG. 29 is a partial cross-sectional front view of an aspect of the spark plug being assembled to the ignition coil in which a coil spring and the conductive terminal are eccentric in a radial direction relative to a protective portion, showing a state in which a terminal metal fitting and the conductive terminal are not in contact, according to the eighth embodiment.

First, as shown in FIG. 29, a case in which the center axis c1 of the coil spring 6 and the conductive terminal 7 of the conductive member 2 is shifted in the radial direction R relative to the center axis c2 of the protective portion 3, in a state before the spark plug 4 is assembled to the ignition coil 1, is assumed. That is, a case in which the coil spring 6 and the conductive terminal 7 are assembled so as to be eccentric toward one side in the radial direction R relative to the protective portion 3 is assumed. Here, one side in the radial direction R that is the side toward which the coil spring 6 and the conductive terminal 7 are eccentric relative to the protective portion 3 is referred to as an eccentric side X5. A side opposite the eccentric side X5 is an anti-eccentric side X6.

Figure 30:
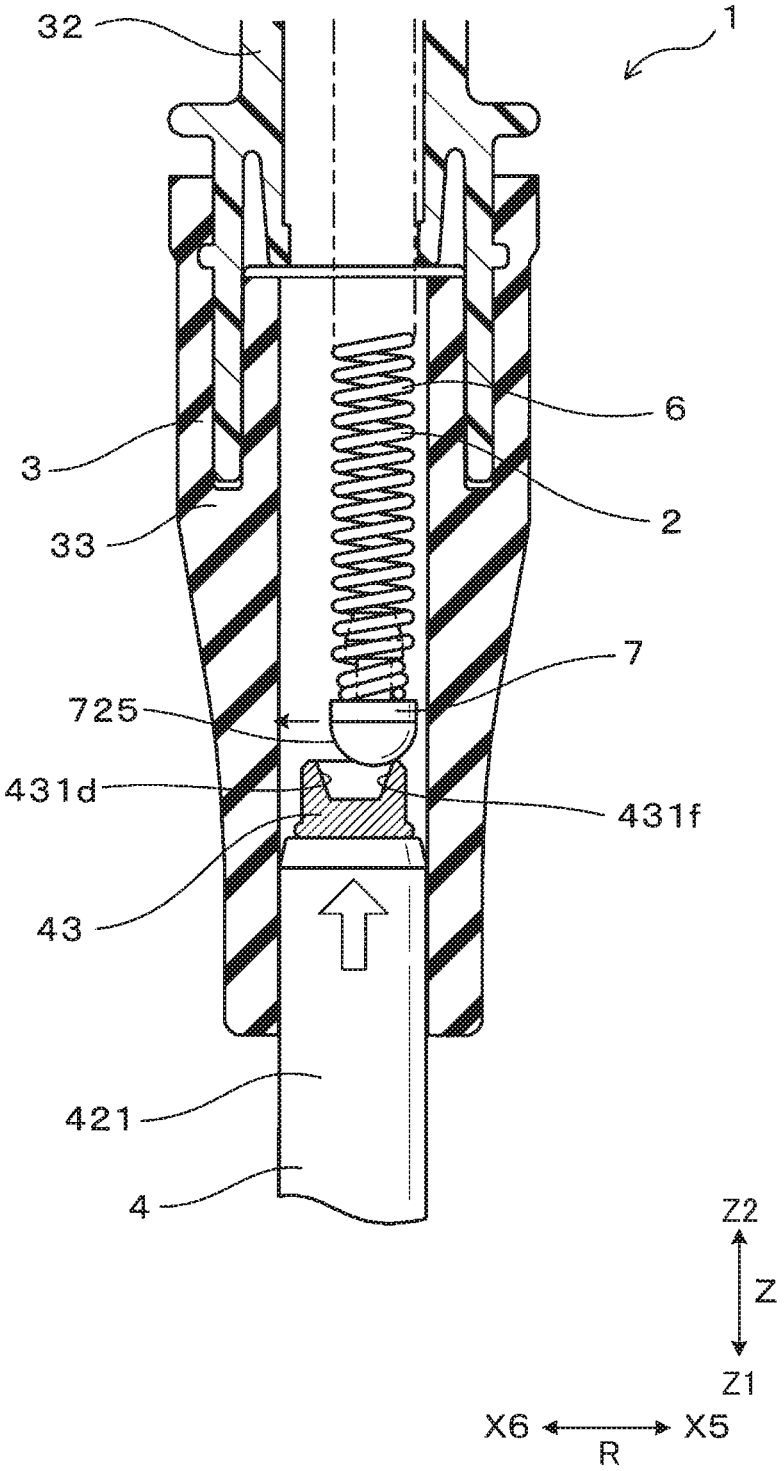
FIG. 30 is a partial cross-sectional front view of an aspect of the spark plug being assembled to the ignition coil in which the coil spring and the conductive terminal are eccentric in a radial direction relative to a protective portion, showing a state in which the terminal metal fitting and the conductive terminal are in contact, according to the eighth embodiment.
Figure 31:
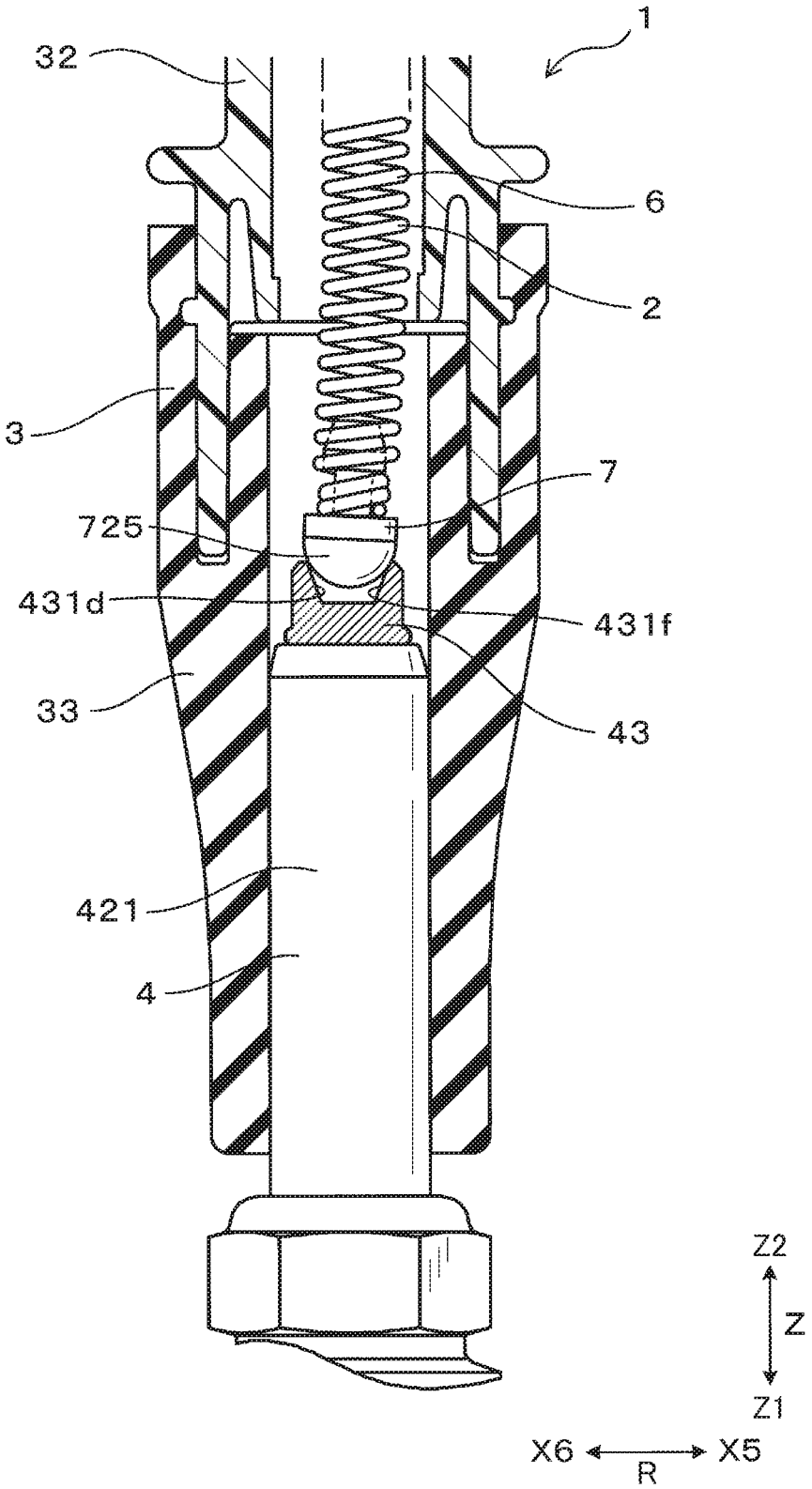
FIG. 31 is a partial cross-sectional front view of an aspect of the spark plug being assembled to the ignition coil in which the coil spring and the conductive terminal are eccentric in a radial direction relative to a protective portion, showing a state in which the spark plug is assembled to the ignition coil, according to the eighth embodiment.

When the insulator head portion 421 of the spark plug 4 is inserted into the plug cap 33 of the ignition coil 1 from the distal end of the plug cap 33, first, the convex surface 725 of the conductive terminal 7 is inserted inside the terminal concave surface 431*d* of the terminal metal fitting 43. As shown in FIG. 30, a portion of the terminal concave surface 431*d* of the protruding terminal portion 431 on the eccentric side X5 abuts on a portion of the convex surface 725 on the eccentric side X5. In addition, when the insertion of the spark plug 4 into the plug cap 33 further progresses, the coil spring 6 is compressed in the axial direction Z, while the conductive terminal 7 is pressed by the terminal metal fitting 43 and moved toward the proximal end side Z2. At the same time, the convex surface 725 of the conductive terminal 7 slides over the terminal concave side surface 431*f* of the terminal metal fitting 43. The conductive terminal 7 moves toward the anti-eccentric side X6. As shown in FIG. 31, the convex surface 725 of the conductive terminal 7 and the terminal concave side surface 431*f* of the terminal metal fitting 43 are in contact in an annular shape.

In addition, in the state in which the spark plug 4 is assembled to the ignition coil 1, compared to the state before assembly, the amount of eccentricity between the center axis c1 of the coil spring 6 and the conductive terminal 7, and the center axis c2 of the protective portion 3 is reduced. That is, as a result of the spark plug 4 being assembled to the ignition coil 1, the center axis c1 of the coil spring 6 and the conductive terminal 7 is adjusted so as to align with the center axis c2 of the protective portion 3.

Figure 32:
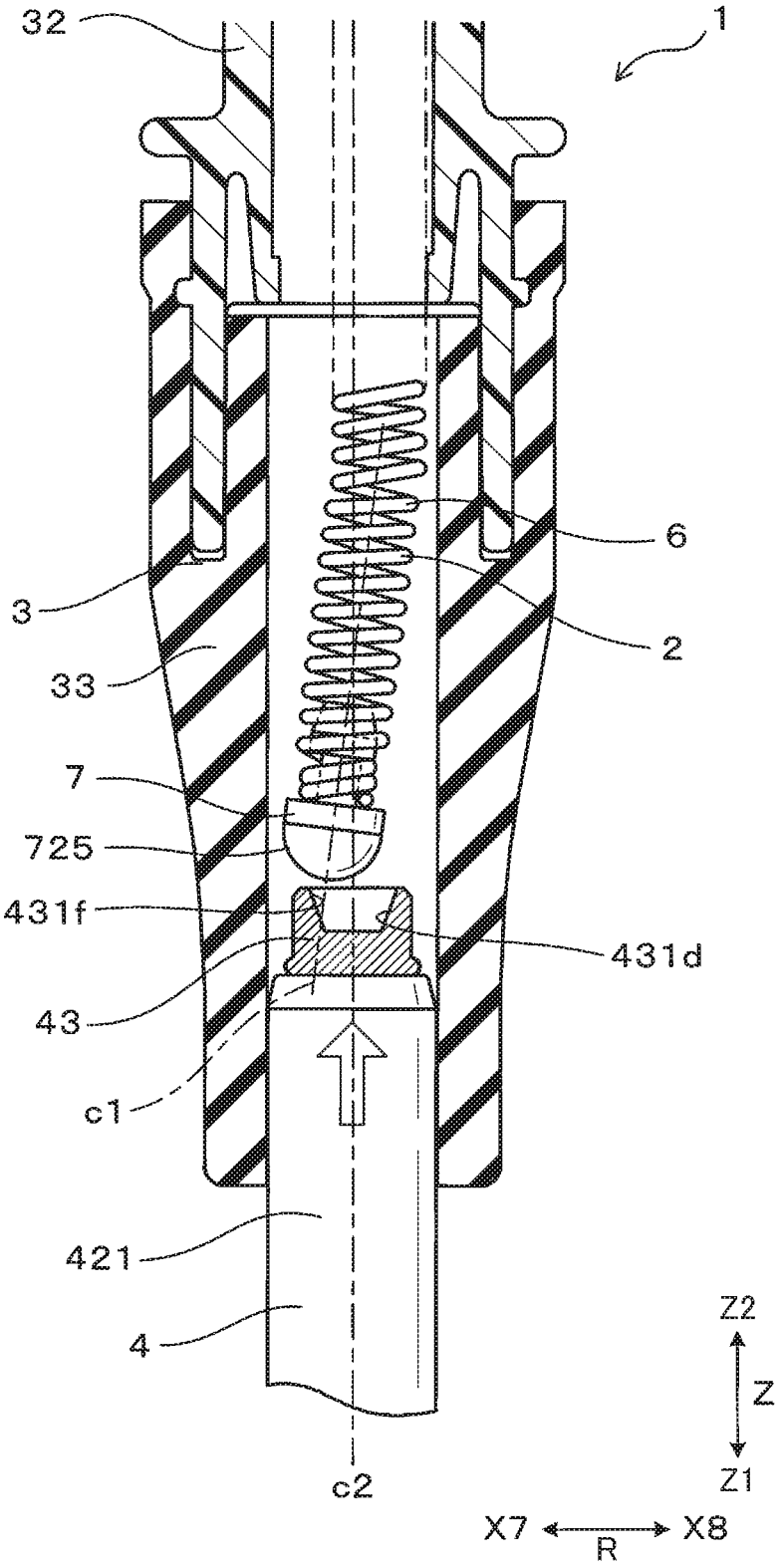
FIG. 32 is a partial cross-sectional front view of an aspect of the spark plug being assembled to the ignition coil in which a center axis of the coil spring and the conductive terminal is tilted relative to a center axis of the protective portion, showing a state in which the terminal metal fitting and the conductive terminal are not in contact, according to the eighth embodiment.

Next, as shown in FIG. 32, a case in which the center axis c1 of the coil spring 6 and the conductive terminal 7 of the conductive member 2 is tilted relative to the center axis c2 of the protective portion 3 is assumed. Here, the center axis c1 of the coil spring 6 and the conductive terminal 7 of the conductive member 2 is tilted further toward a tilting side X7 toward the distal end side Z1. The tilting side X7 is one side in the radial direction R. In addition, a side opposite the tilting side X7 in the radial direction R is an anti-tilting side X8.

Figure 33:
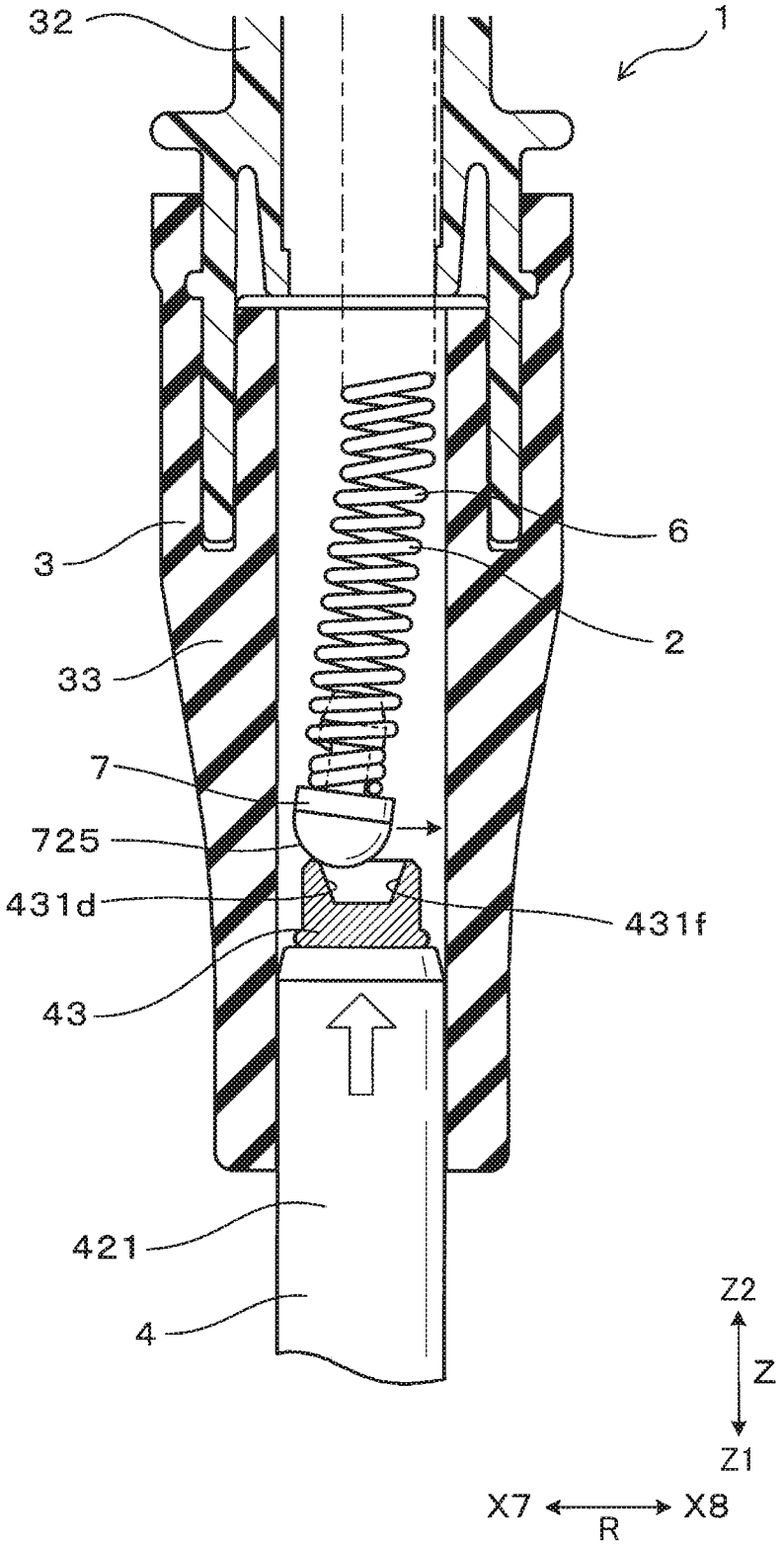
FIG. 33 is a partial cross-sectional front view of an aspect of the spark plug being assembled to the ignition coil in which the center axis of the coil spring and the conductive terminal is tilted relative to the center axis of the protective portion, showing a state in which the terminal metal fitting and the conductive terminal are in contact, according to the eighth embodiment.
Figure 34:
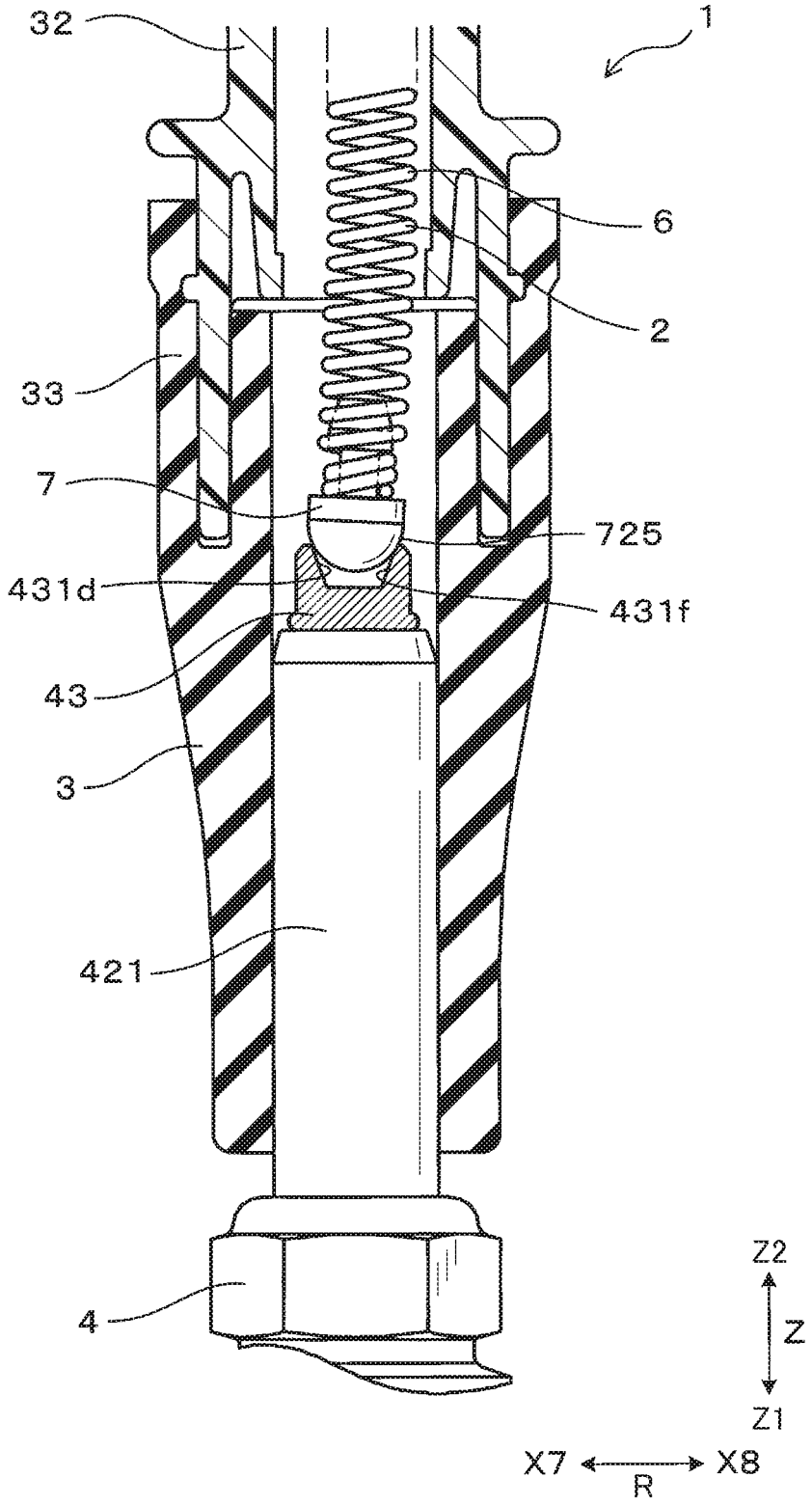
FIG. 34 is a partial cross-sectional front view of an aspect of the spark plug being assembled to the ignition coil in which the center axis of the coil spring and the conductive terminal is tilted relative to the center axis of the protective portion, showing a state in which the spark plug is assembled to the ignition coil, according to the eighth embodiment.

In this case, when the insulator head portion 421 of the spark plug 4 is inserted into the plug cap 33 of the ignition coil 1 from the distal end of the plug cap 33, first, as shown in FIG. 33, the convex surface 725 of the conductive terminal 7 is inserted inside the terminal concave surface 431*d* of the terminal metal fitting 43. A portion of the terminal concave surface 431*d* of the protruding terminal portion 431 on the tilting side X7 abuts on a portion of the convex surface 725 on the tilting side X7. Then, when insertion of the spark plug 4 into the plug cap 33 further progresses, the coil spring 6 is compressed in the axial direction Z while the conductive terminal 7 is pressed toward the proximal end side Z2 by the terminal metal fitting 43 and moved toward the proximal end side Z2. At the same time, the convex surface 725 of the conductive terminal 7 slides over the terminal concave side surface 431*f* of the terminal metal fitting 43 and moves toward the anti-tilting side X8. As shown in FIG. 34, the convex surface 725 and the terminal concave side surface 431*f* of the terminal metal fitting 43 are in contact in an annular shape.

In addition, in the state in which the spark plug 4 is assembled to the ignition coil 1, compared to the state before assembly, an angle of tilting of the center axis c1 of the coil spring 6 and the conductive terminal 7 relative to the center axis c2 of the protective portion 3 is reduced. That is, as a result of the spark plug 4 being assembled to the ignition coil 1, the tilt of the center axis c1 of the coil spring 6 and the conductive terminal 7 is corrected such that the center axis c1 runs along the axial direction Z.

Other configurations are similar to those according to the first embodiment.

Next, effects according to the present embodiment will be described.

According to the present embodiment, the conductive terminal 7 is attached to the distal end of the coil spring 6. In addition, the distal end surface of the conductive terminal 7 has the convex surface 725 that protrudes toward the distal end side Z1 toward the inner circumferential side. The convex surface 725 abuts on the terminal metal fitting 43 of the spark plug 4. In addition, the distal end surface of the conductive terminal 7 is configured such that the contact portion with the terminal metal fitting 43 of the spark plug is formed into an annular shape. Therefore, contact area between the convex surface 725 and the terminal metal fitting 43 of the spark plug 4 can be increased. Reliability of electrical connection between the conductive member 2 and the terminal metal fitting 43 of the spark plug 4 can be easily ensured.

In addition, the convex surface 725 is formed so as to protrude toward the inner circumferential side toward the distal end side Z1. Therefore, even in cases in which the center axis of the conductive member 2 is eccentric or tilted relative to the center axis of the protective portion 3, as described above, the eccentricity or tilting is corrected.

Furthermore, the convex surface 725 is formed into a spherical surface. Therefore, even if the conductive member 2 is eccentric or tilted to any side in the circumferential direction CR relative to the center axis of the protective portion 3, the eccentricity or tilting can be corrected as a result of the spark plug 4 being assembled to the ignition coil 1.

Other effects similar to those according to the first embodiment can be obtained.

Ninth Embodiment

Figure 35:
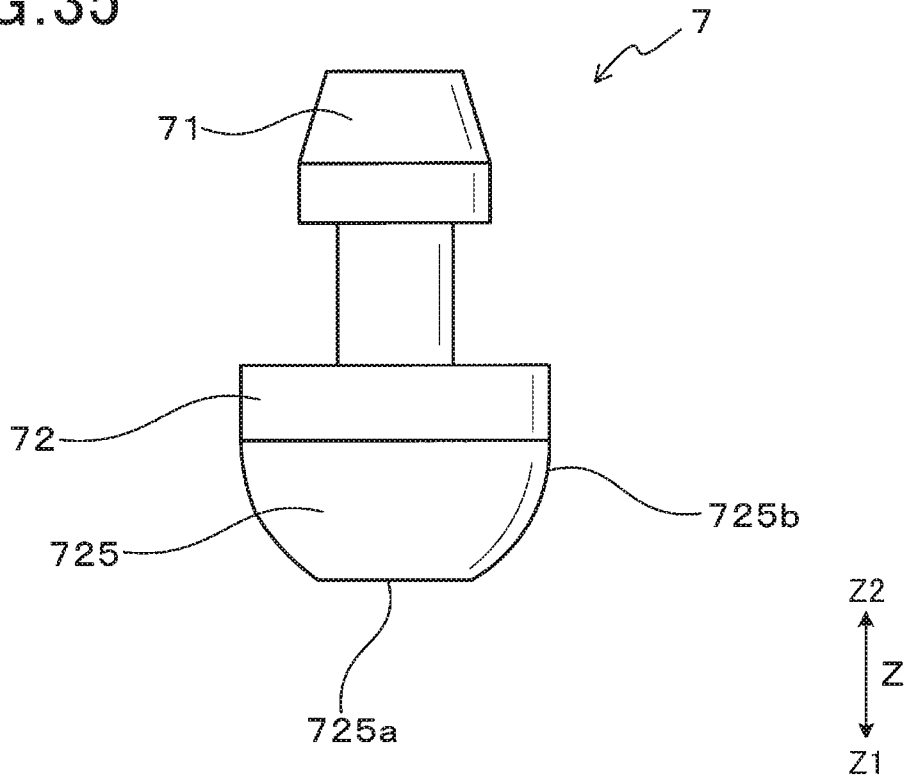
FIG. 35 is a front view of a conductive terminal according to a ninth embodiment.

As shown in FIG. 35, according to a ninth embodiment, the shape of the convex surface 725 of the conductive terminal 7 is changed from that according to the eighth embodiment.

The convex surface 725 according to the present embodiment includes a convex top surface 725*a* and a convex side surface 725*b*. The convex top surface 725*a* is formed in the distal end of the convex surface 725 and is formed into a planar shape that is orthogonal to the axial direction Z. The convex side surface 725*b* extends toward the proximal end side Z2 from the overall circumference of the convex top surface 725*a*. The convex side surface 725*b* curves toward the inner circumferential side toward the distal end side Z1 (that is, the convex top surface 725*a* side). The convex side surface 725*b* is curved so as to swell toward the outer circumferential side in the radial direction R. In addition, in a state in which the spark plug 4 is assembled to the ignition coil 1, the convex side surface 725*b* and the terminal concave side surface 431*f* of the terminal metal fitting 43 are in contact in an annular shape.

Other configurations are similar to those according to the eighth embodiment.

According to the present embodiment as well, effects similar to those according to the eighth embodiment can be obtained.

Tenth Embodiment

Figure 36:
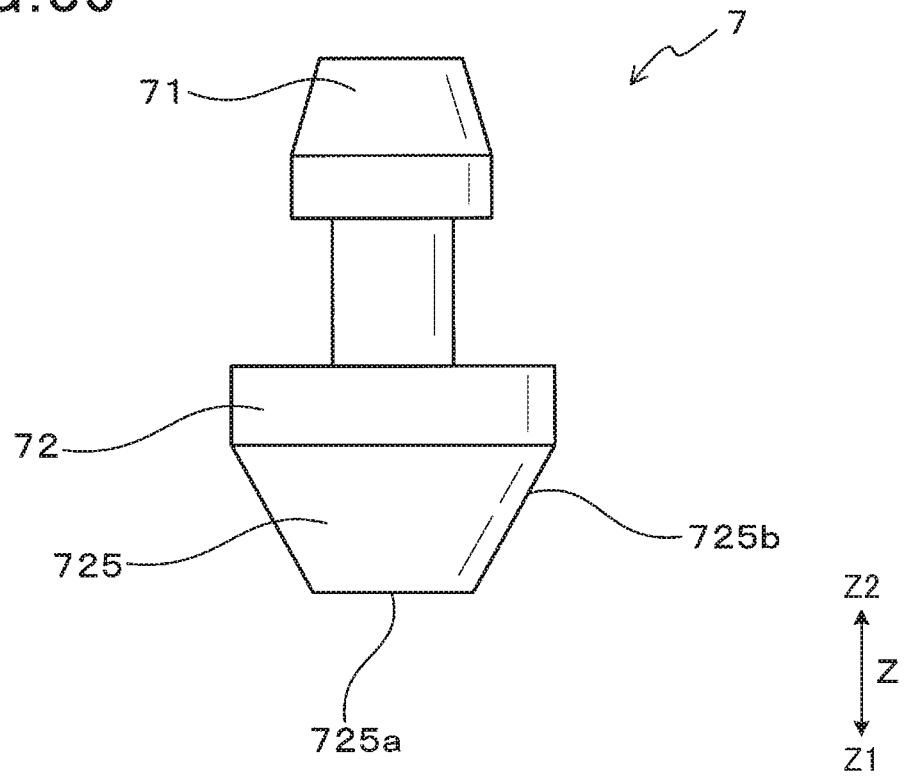
FIG. 36 is a front view of a conductive terminal according to a tenth embodiment.
Figure 37:
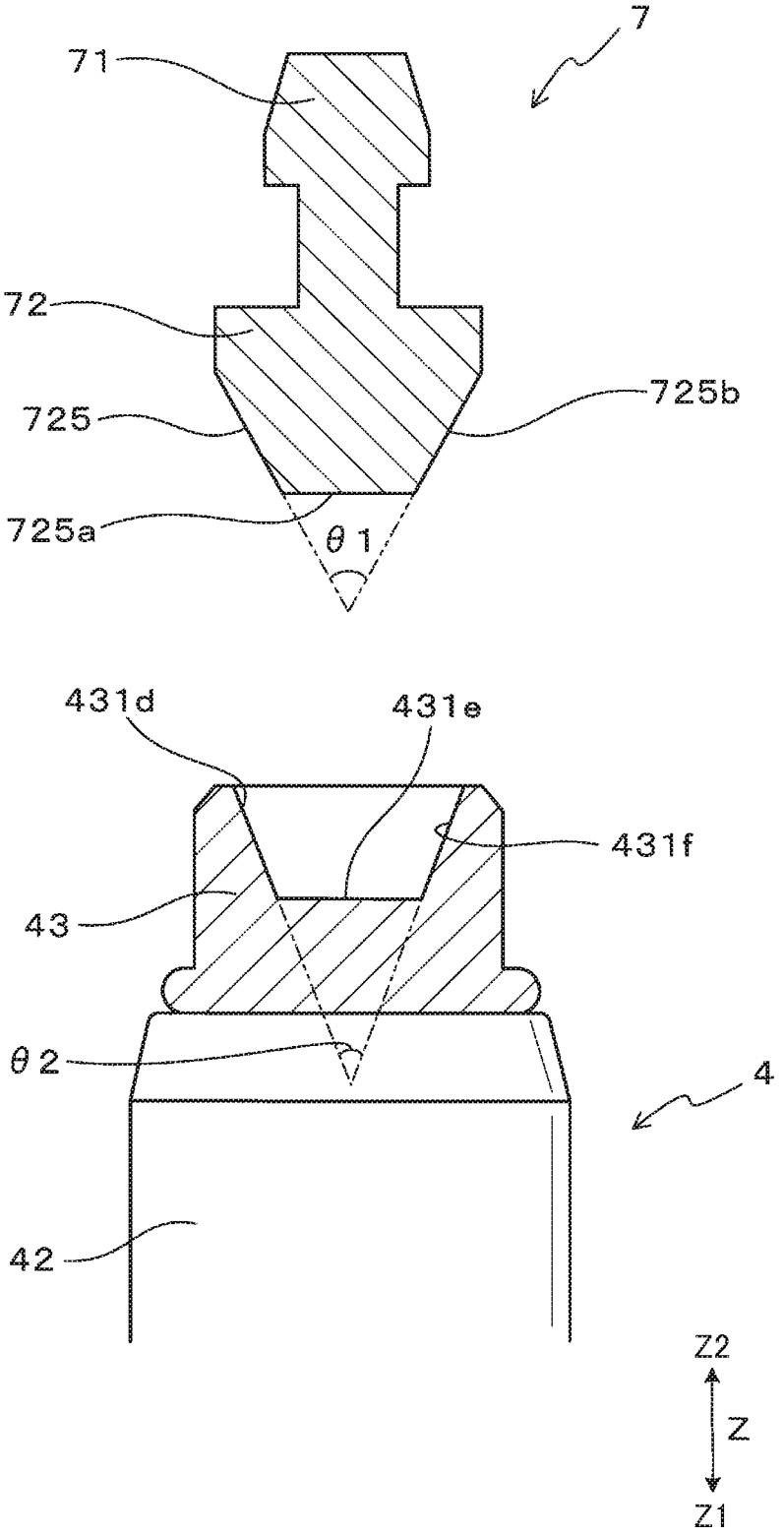
FIG. 37 is a partial cross-sectional front view of the conductive terminal and a proximal end portion of a spark plug according to the tenth embodiment.

As shown in FIG. 36 and FIG. 37, according to a tenth embodiment, the shape of the convex side surface 725*b* is changed from that according to the ninth embodiment.

According to the present embodiment, the convex side surface 725*b* is formed into a tapered shape that tapers toward the inner circumferential side (radially inward) toward the distal end side Z1. That is, the convex side surface 725*b* has a linear shape on a cross-section that passes through the center axis of the conductive terminal 7 and is parallel to the center axis.

As shown in FIG. 37, a taper angle θ1 of the convex surface 725 is greater than a taper angle θ2 of the terminal concave side surface 431*f*. The taper angle θ1 of the convex surface 725 is an angle formed by extension lines of a pair of convex side surfaces 725*b* that appear on the cross-section that passes through the center axis of the conductive terminal 7 and is parallel to the center axis. In addition, the taper angle θ2 of the terminal concave side surface 431*f* is an angle formed by extension lines of a pair of terminal concave side surfaces 431*f* that appear on a cross-section that passes through the center axis of the spark plug 4 and is parallel to the center axis.

Other configurations are similar to those according to the ninth embodiment.

According to the present embodiment, the taper angle θ1 of the convex surface 725 is greater than the taper angle θ2 of the terminal concave side surface 431*f*. Therefore, when the spark plug 4 is assembled to the ignition coil 1, the convex top surface 725*a* of the plug connecting portion 72 striking the terminal concave bottom surface 431*e* of the terminal metal fitting 43 is prevented. In addition, the convex side surface 725*b* abuts on the terminal concave side surface 431*f* in the annular shape with certainty.

Other effects similar to those according to the ninth embodiment can be obtained.

Eleventh Embodiment

Figure 38:
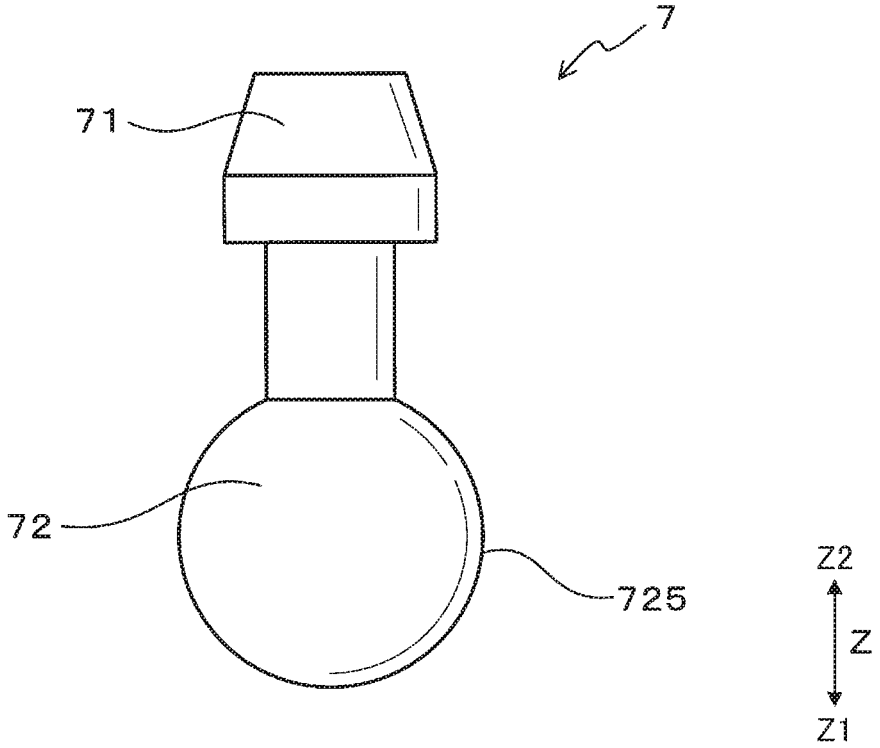
FIG. 38 is a front view of a conductive terminal according to an eleventh embodiment.

As shown in FIG. 38, according to an eleventh embodiment, the shape of the plug connecting portion 72 is changed from that according to the eighth embodiment.

According to the present embodiment, the plug connecting portion 72 as a whole is formed into a substantially spherical shape. Specifically, the plug connecting portion 72 has a shape in which a proximal end-side end portion of a sphere is cut off in a planar direction that is orthogonal to the axial direction Z. In accompaniment, the surface of the plug connecting portion 72 is a substantially spherical convex surface 725. In addition, a portion of the convex surface 725 on the distal end side Z1 from substantially the center in the axial direction Z is formed into a hemispherical surface toward the inner circumferential side toward the distal end side Z1.

Other configurations are similar to those according to the eighth embodiment.

According to the present embodiment as well, effects similar to those according to the eighth embodiment can be obtained.

Twelfth Embodiment

Figure 39:
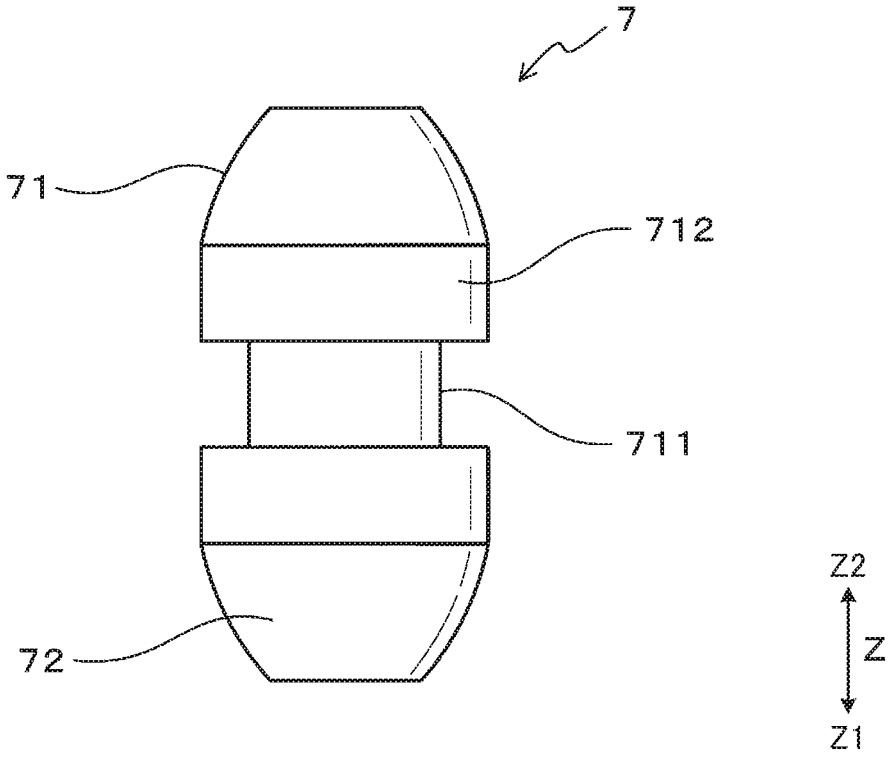
FIG. 39 is a front view of a conductive terminal according to a twelfth embodiment.

As shown in FIG. 39, according to a twelfth embodiment, the shape of the conductive terminal 7 is changed from that according to the eighth embodiment.

According to the present embodiment, the conductive terminal 7 is formed so as to have a symmetrical shape in the axial direction Z. That is, even when an attitude of the conductive terminal 7 is inverted in the axial direction Z, the shape of the conductive terminal 7 is the same as that before inversion. In a manner similar to that according to the eighth embodiment, the conductive terminal 7 includes the spring connecting portion 71 and the plug connecting portion 72. The spring connecting portion 71 includes the small diameter portion 711 and the large diameter portion 712. The plug connecting portion 72 has a shape similar to that according to the eighth embodiment. In addition, the large diameter portion 712 of the spring connecting portion 71 has a shape similar to that of the plug connecting portion 72 inverted in the axial direction Z. Furthermore, between the plug connecting portion 72 and the spring connecting portion 71, the small diameter portion 711 that has a smaller diameter than the plug connecting portion 72 and the spring connecting portion 71 is formed.

Other configurations are similar to those according to the eighth embodiment.

According to the present embodiment, the conductive terminal 7 has a shape that is symmetrical in the axial direction Z. Therefore, productivity in manufacturing of the ignition coil 1 can be easily improved. That is, in the step of assembling the ignition coil 1, a step of confirming the distal end side Z1 and the proximal end side Z2 of the conductive terminal 7 in the axial direction can be omitted. Efficiency in assembling the ignition coil 1 can be improved.

Other effects similar to those according to the eighth embodiment can be obtained.

Thirteenth Embodiment

Figure 40:
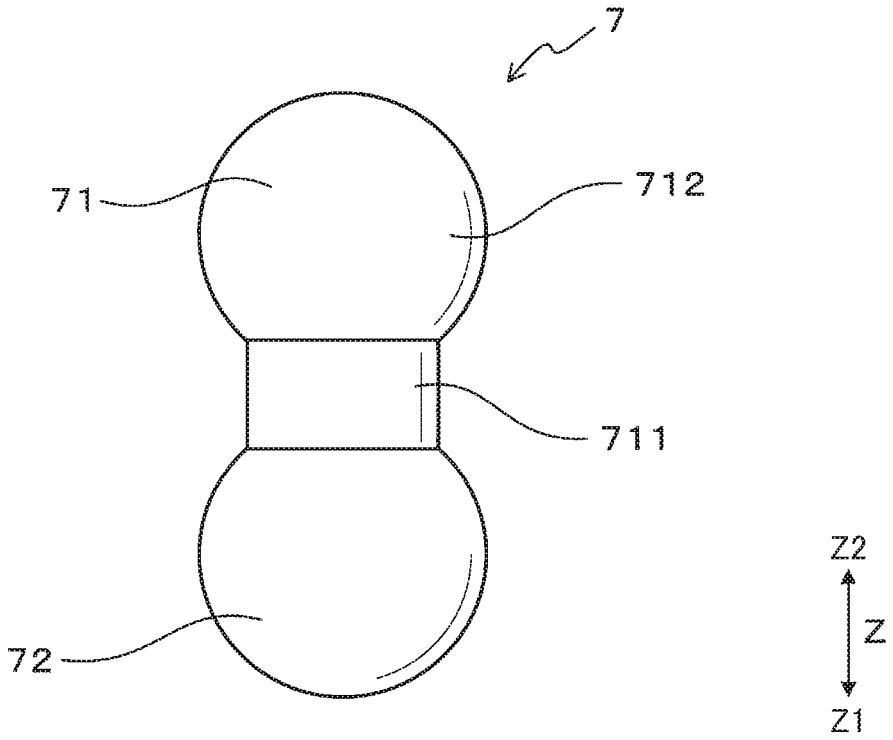
FIG. 40 is a front view of a conductive terminal according to a thirteenth embodiment.

As shown in FIG. 40, according to a thirteenth embodiment, the conductive terminal 7 is configured to have a shape that is symmetrical in the axial direction Z, in a manner similar to that according to the twelfth embodiment.

According to the present embodiment as well, the conductive terminal 7 includes the spring connecting portion 71 and the plug connecting portion 72. The spring connecting portion 71 includes the small diameter portion 711 and the large diameter portion 712. The plug connecting portion 72 has a shape that is similar to that according to the eleventh embodiment. In addition, the large diameter portion 712 of the spring connecting portion 71 has a shape that is similar to that of the plug connecting portion 72 inverted in the axial direction Z. Furthermore, between the plug connecting portion 72 and the spring connecting portion 71, the small diameter portion 711 that has a smaller diameter than the plug connecting portion 72 and the spring connecting portion 71 is formed.

Other configurations are similar to those according to the twelfth embodiment.

According to the present embodiment as well, effects similar to those according to the twelfth embodiment can be obtained.

The present disclosure is not limited by the above-described embodiments. Various embodiments are applicable without departing from the spirit of the present disclosure.

For example, the shape of the spring connecting portion according to the eighth to eleventh embodiments can be changed to the shape according to the seventh embodiment. In addition, the shape of the protruding terminal portion of the terminal metal fitting according to the first to seventh embodiments can be changed to the shape according to the eighth embodiment.

What is claimed is:

1. An ignition coil comprising:

a coil main body portion that generates a high voltage;

a conductive member that electrically connects the coil main body portion and a terminal metal fitting of a spark plug; and a protective portion that has an electrically insulating property, the conductive member being arranged inside of the protective portion, wherein the conductive member includes an elastic portion that elastically deforms in a longitudinal direction of the conductive member, and a conductive terminal that is arranged on a distal end side of the elastic portion, the conductive terminal has a distal end surface that includes a concave surface, the concave surface being formed to be recessed toward a proximal end side toward an inner circumference side, a contact portion between the concave surface and the terminal metal fitting of the spark plug having an annular shape, and the concave surface is formed into a spherical surface.

2. An ignition coil comprising:

a coil main body portion that generates a high voltage;

a conductive member that electrically connects the coil main body portion and a terminal metal fitting of a spark plug; and a protective portion that has an electrically insulating property, the conductive member being arranged inside of the protective portion, wherein the conductive member includes an elastic portion that elastically deforms in a longitudinal direction of the conductive member, and a conductive terminal that is arranged on a distal end side of the elastic portion, the conductive terminal has a distal end surface that includes a convex surface that abuts on the terminal metal fitting of the spark plug, the convex surface being formed to protrude toward a distal end side toward an inner circumference side, a contact portion between the convex surface and the terminal metal fitting of the spark plug having an annular shape.

3. The ignition coil according to claim 2, wherein:

the convex surface is formed into a spherical surface.

4. The ignition coil according to claim 2, wherein:

the convex surface is formed into a tapered shape that tapers toward the inner circumferential side toward the distal end side, and is configured to abut on, in an annular shape, a terminal concave surface that is formed into a tapered shape that tapers toward the distal end side toward the inner circumferential side on a proximal end surface of the terminal metal fitting; and a taper angle of the convex surface is greater than a taper angle of the terminal concave surface.

5. An ignition coil comprising:

a coil main body portion that generates a high voltage;

a conductive member that electrically connects the coil main body portion and a terminal metal fitting of a spark plug; and a protective portion that has an electrically insulating property, the conductive member being arranged inside of the protective portion, wherein:

the conductive member includes an elastic portion that elastically deforms in a longitudinal direction of the conductive member, and a conductive terminal that is arranged on a distal end side of the elastic portion;

the conductive terminal has a distal end surface that includes a concave surface or a convex surface that abuts on the terminal metal fitting of the spark plug, the concave surface being formed to be recessed toward a proximal end side toward an inner circumference side, the convex surface being formed to protrude toward a distal end side toward the inner circumference side, a contact portion between the concave surface or the convex surface and the terminal metal fitting of the spark plug having an annular shape;

the elastic portion is configured by a coil spring that stretches and contracts in a longitudinal direction of the conductive member;

the conductive terminal includes a small diameter portion of which an external form when viewed in the longitudinal direction is smaller than that of a portion adjacent to the small diameter portion on a proximal end side; and a distal end portion of the coil spring is wound around the small diameter portion by a single turn or more.

6. The ignition coil according to claim 5, wherein:

the distal end surface of the conductive terminal is the concave surface.

7. The ignition coil according to claim 6, wherein:

the concave surface is formed into a spherical surface.

8. The ignition coil according to claim 5, wherein:

the distal end surface of the conductive terminal is the convex surface.

9. The ignition coil according to claim 8, wherein:

the convex surface is formed into a spherical surface.

10. The ignition coil according to claim 8, wherein:

the convex surface is formed into a tapered shape that tapers toward the inner circumferential side toward the distal end side, and is configured to abut on, in an annular shape, a terminal concave surface that is formed into a tapered shape that tapers toward the distal end side toward the inner circumferential side on a proximal end surface of the terminal metal fitting; and a taper angle of the convex surface is greater than a taper angle of the terminal concave surface.

* * * * *